US007596972B2

(12) United States Patent
Knight, Sr. et al.

(10) Patent No.: US 7,596,972 B2
(45) Date of Patent: Oct. 6, 2009

(54) TUBULAR KNIT FABRIC HAVING ALTERNATING COURSES OF SLIVER FIBER PILE AND CUT-PILE FOR PAINT ROLLER COVERS

(75) Inventors: John Cecil Knight, Sr., North, SC (US); Daniel L. Sinykin, Bayside, WI (US)

(73) Assignee: Seamless Technologies, LLC, Janesville, WI (US)

( * ) Notice: Subject to any disclaimer, the term of this patent is extended or adjusted under 35 U.S.C. 154(b) by 0 days.

(21) Appl. No.: 12/403,694

(22) Filed: Mar. 13, 2009

(65) Prior Publication Data

US 2009/0170677 A1 Jul. 2, 2009

Related U.S. Application Data

(63) Continuation-in-part of application No. 12/116,022, filed on May 6, 2008, which is a continuation-in-part of application No. 11/740,119, filed on Apr. 25, 2007, now Pat. No. 7,503,191, and a continuation-in-part of application No. 12/015,612, filed on Jan. 17, 2008, and a continuation-in-part of application No. 12/100,050, filed on Apr. 9, 2008.

(51) Int. Cl.
*D04B 11/08* (2006.01)

(52) U.S. Cl. ..... 66/191; 66/194

(58) Field of Classification Search ..... 66/191, 66/194, 190, 195, 9 R, 10–12; 442/312, 442/313

See application file for complete search history.

(56) References Cited

U.S. PATENT DOCUMENTS 1,152,110 A 8/1915 Lockwood
1,660,538 A 2/1928 Whitney
1,791,741 A * 2/1931 Moore ..... 428/95
1,849,466 A * 3/1932 Moore ..... 66/157
2,411,842 A 12/1946 Adams
2,502,638 A 4/1950 Becht (Continued)

OTHER PUBLICATIONS

International Search Report and Written Opinion; International Application No. PCT/US2008/61394; date of actual completion of the international search Oct. 30, 2008; date of actual mailing of the international search report Nov. 12, 2008, 10 pages.

(Continued)

*Primary Examiner*—Danny Worrell
(74) *Attorney, Agent, or Firm*—Reinhart Boerner Van Deuren P.C.

(57) ABSTRACT

A tubular knit fabric is disclosed that is manufactured with a pile extending from the outer side thereof and in an extended length, small diameter configuration, the tubular knit pile fabric subsequently being separable into shorter tubular segments that may be secured to paint roller cover cores to produce seamless paint rollers. The knit paint roller cover fabric of the present invention is manufactured in a tubular segment with cut-pile and sliver pile segments disposed in alternating courses and extending from the outside of the tubular knit paint roller cover fabric. The tubular knit paint roller cover fabric of the present invention is also manufactured in a size that makes it appropriate for installation onto paint roller cover cores.

30 Claims, 25 Drawing Sheets

U.S. PATENT DOCUMENTS 2,600,955 A * 6/1952 Grosse et al. ..... 112/80.3
2,630,619 A * 3/1953 Schmidt et al. ..... 428/95
2,704,877 A * 3/1955 Schmidt ..... 26/15 R
2,737,702 A * 3/1956 Schmidt et al. ..... 428/89
2,752,953 A * 7/1956 Schmidt ..... 138/140
2,789,075 A 4/1957 Stahl
2,806,803 A 9/1957 Thackara et al.
2,920,372 A * 1/1960 Sannipoli et al. ..... 26/2 R
2,944,588 A * 7/1960 Sannipoli et al. ..... 156/294
2,948,200 A 8/1960 Westerbarkey
3,010,867 A * 11/1961 Sannipoli et al. ..... 156/367
3,126,306 A 3/1964 Sherman
3,181,233 A 5/1965 Sannipoli et al.
3,226,799 A 1/1966 Grodberg et al.
3,226,952 A * 1/1966 Cassady ..... 66/9 B
3,299,672 A * 1/1967 Schmidt ..... 66/9 R
3,301,734 A 1/1967 Britton et al.
3,366,719 A 1/1968 Lueders
3,376,180 A 4/1968 Larson et al.
3,404,203 A 10/1968 Donald
3,429,522 A 2/1969 Cunningham et al.
3,430,543 A 3/1969 Cunningham
3,453,163 A 7/1969 Mills et al.
3,457,130 A 7/1969 Morrison
3,518,970 A 7/1970 Burns et al.
3,607,492 A 9/1971 Keith et al.
3,620,869 A 11/1971 Stump et al.
3,700,520 A 10/1972 Hielema
3,732,135 A * 5/1973 Ernst et al. ..... 156/72
3,761,335 A 9/1973 Cichoski et al.
3,853,680 A * 12/1974 Daniel ..... 428/95
3,894,407 A * 7/1975 Clingan et al. ..... 66/9 B
3,894,409 A * 7/1975 Clingan et al. ..... 66/191
3,896,637 A 7/1975 Thore
3,905,853 A 9/1975 Stent
3,960,624 A 6/1976 Erlandson
4,010,054 A 3/1977 Bradt
4,078,957 A 3/1978 Bradt
4,112,565 A 9/1978 Sailas
4,191,792 A 3/1980 Janssen
4,192,697 A 3/1980 Parker et al.
4,236,286 A * 12/1980 Abler et al. ..... 28/160
4,245,487 A * 1/1981 Schaab et al. ..... 66/9 B
4,378,267 A 3/1983 Saito
4,395,869 A 8/1983 Priaroggia et al.
4,415,611 A * 11/1983 Yamagata et al. ..... 428/15
4,466,151 A * 8/1984 Barch et al. ..... 15/229.13
4,513,042 A * 4/1985 Lumb ..... 428/95
4,532,780 A * 8/1985 Tilson et al. ..... 66/9 B
4,546,020 A * 10/1985 Sakai et al. ..... 428/16
4,592,212 A 6/1986 Schmidt
4,592,213 A * 6/1986 Tilson et al. ..... 66/9 B
4,692,975 A * 9/1987 Garcia ..... 492/29
4,798,748 A * 1/1989 Kitamura et al. ..... 428/15
5,051,586 A 9/1991 Sabreen
5,108,780 A 4/1992 Pitt et al.
5,137,595 A 8/1992 Garcia
5,195,242 A 3/1993 Sekar
5,206,968 A 5/1993 Bower et al.
5,273,604 A 12/1993 Alvarez Garcia
5,294,276 A 3/1994 Linn et al.
5,397,414 A 3/1995 Garcia et al.
5,398,409 A 3/1995 Sekar
5,431,029 A 7/1995 Kuhrau et al.
5,468,207 A 11/1995 Bower et al.
5,537,745 A 7/1996 Musch et al.
5,546,768 A * 8/1996 Kuhrau et al. ..... 66/9 B
5,572,790 A * 11/1996 Sekar ..... 29/895.211
5,577,402 A * 11/1996 Kuhrau et al. ..... 66/9 B
5,614,047 A 3/1997 Garcia
RE35,526 E 6/1997 Alvarez Garcia
5,685,176 A * 11/1997 Kuhrau et al. ..... 66/9 B
5,694,688 A 12/1997 Musch et al.
5,759,329 A 6/1998 Krause et al.
5,855,715 A 1/1999 Langford et al.
5,862,591 A 1/1999 Kulaski
5,874,032 A 2/1999 Zdrahala et al.
6,016,670 A * 1/2000 Kuhrau et al. ..... 66/152
6,019,934 A 2/2000 Schulte
6,145,196 A 11/2000 Ripstein
6,151,920 A * 11/2000 Schindler et al. ..... 66/9 R
6,159,134 A 12/2000 Sekar
6,159,320 A * 12/2000 Tams et al. ..... 156/187
6,203,648 B1 3/2001 Barton et al.
6,254,710 B1 7/2001 Sekar
6,324,717 B1 12/2001 Sekar
6,502,779 B1 * 1/2003 Jelinek et al. ..... 242/413.5
6,615,490 B2 9/2003 Polzin
6,660,118 B2 12/2003 Tams et al.
6,685,121 B1 * 2/2004 Jelinek et al. ..... 242/178
6,766,668 B2 * 7/2004 Sinykin ..... 66/191
6,902,131 B1 * 6/2005 Jelinek et al. ..... 242/413.5
6,918,552 B2 * 7/2005 Jelinek et al. ..... 242/178
6,929,203 B1 8/2005 Jelinek et al.
6,993,941 B2 * 2/2006 Yamaguchi ..... 66/202
7,503,190 B1 3/2009 Knight, Sr. et al.
7,503,191 B2 3/2009 Knight et al.
2002/0042331 A1 4/2002 Fortner et al.
2002/0091051 A1 7/2002 Sekar
2003/0213083 A1 11/2003 Yamaguchi
2008/0263802 A1 10/2008 Knight et al.
2008/0264110 A1 10/2008 Sinykin
2008/0265468 A1 10/2008 Sinykin
2008/0269033 A1 10/2008 Sinykin

OTHER PUBLICATIONS

International Search Report and Written Opinion; International Application No. PCT/US2008/61395; date of actual completion of the international search Nov. 11, 2008; date of actual mailing of the international search report Nov. 18, 2008, 8 pages.

* cited by examiner

TUBULAR KNIT FABRIC HAVING ALTERNATING COURSES OF SLIVER FIBER PILE AND CUT-PILE FOR PAINT ROLLER COVERS

CROSS-REFERENCE TO RELATED PATENT APPLICATIONS

This patent application is a continuation-in-part of co-pending U.S. patent application Ser. No. 12/116,022, filed on May 6, 2008, entitled "Tubular Cut Pile Knit Fabric for Paint Roller Covers." U.S. patent application Ser. No. 12/116,022 is a continuation-in-part of co-pending U.S. patent application Ser. No. 11/740,119, filed on Apr. 25, 2007, entitled "Tubular Sliver Knit Fabric for Paint Roller Covers," and a continuation-in-part of co-pending U.S. patent application Ser. No. 12/015,612, filed on Jan. 17, 2008, entitled "Method of Manufacturing Paint Roller Covers from a Tubular Fabric Sleeve," and a continuation-in-part of co-pending U.S. patent application Ser. No. 12/100,050, filed on Apr. 9, 2008, entitled "Method of Manufacturing Paint Roller Covers From a Tubular Fabric Sleeve," all four of which patent applications are assigned to the assignee of the present invention, and all four of which patent applications are hereby incorporated herein by reference in their entirety.

BACKGROUND OF THE INVENTION

The present invention relates generally to knit pile fabrics that may be used to produce paint rollers, and more particularly to a tubular knit pile fabric that is manufactured with the pile extending from the outer side thereof and in an extended length, small diameter configuration, the tubular knit pile fabric subsequently being separable into shorter tubular segments that may be secured to paint roller cover cores to produce seamless paint rollers.

The two inventions which have had the greatest impact on paint application are the invention of the paint roller in the 1930's and the development of water-based paint in the late 1940's. While water-based paints are easy to mix, apply, and clean up, there is little doubt that the paint roller has been the greatest single time saving factor in the paint application process, allowing large surfaces to be painted with a uniform coat of paint quickly and easily. Typically, paint rollers are comprised of two components, namely a handle assembly and a paint roller cover for installation onto the handle assembly.

The handle assembly consists of a grip member having a generally L-shaped metal frame extending therefrom, with the free end of the metal frame having a rotatable support for a paint roller cover mounted thereon. The paint roller cover consists of a thin, hollow cylindrical core which fits upon the rotatable support of the handle, with a plush pile fabric being secured to the outer diameter of the paint roller cover. The core may be made of either cardboard or plastic material, with which material is used for the core generally being determined based upon the selling price of the paint roller cover. The pile fabric is traditionally applied as a strip which is helically wound onto the outer surface of the core with adjacent windings of the fabric strip being located close adjacent each other to provide the appearance of a single continuous pile fabric covering on the core.

Typically, the pile fabric is a dense knitted pile fabric, which may be knitted from natural fibers such as wool or mohair, synthetic fibers such as polyester, acrylic, nylon, or rayon, or from a blend of natural and synthetic fibers. The knitting is typically performed on a circular sliver knitting machine, which produces a tubular knitted base material with a knit-in pile in tubular segments which are approximately fifty-eight inches (1473 millimeters) in circumference by thirty to fifty yards (27.43 meters to 45.728 meters) long (depending on fabric weight).

Generally, sliver knitting is a knitting process which locks individual pile fibers directly into a lightweight knit backing or base material in a manner wherein the pile fibers extend from one side of the knit base material. The knit base material itself is made from yarn, which may be knitted in a single jersey circular knitting process on a circular knitting machine, with closely packed U-shaped tufts of the fibers being knitted into the knit base material which anchors them in the completed pile fabric. The free ends of the fibers extend from one side of the knit base material to provide a deep pile face. The knit base material is typically made of synthetic yarns, with the pile being made of a desired natural or synthetic fiber, or a blend of different fibers.

Such fabrics are illustrated, for example, in U.S. Pat. No. 1,791,741, to Moore, U.S. Pat. No. 2,737,702, to Schmidt et al., U.S. Pat. No. 3,226,952, to Cassady, U.S. Pat. No. 3,853,680, to Daniel, U.S. Pat. No. 3,894,409, to Clingan et al., U.S. Pat. No. 4,236,286, to Abler et al., U.S. Pat. No. 4,513,042, to Lumb, and U.S. Pat. No. 6,766,668, to Sinykin, all of which patents are hereby incorporated herein by reference. Sliver knit high pile fabrics have been widely used for many years in the manufacture of imitation fur fabrics, and also have found use, for example, as linings for overcoats and footwear, as coverings for stuffed toys and floors, in applications in pet beds, case liners, boot and slipper liners, medical pads, and blankets, and, of course, as coverings for paint roller covers.

The components of the knitted fabric are a yarn, which is used to knit the fabric's knit base material, and fibers which are supplied in a "sliver" rope, which consists of fibers which are all longitudinally oriented in a rope which is typically less than three inches (76 millimeters) in diameter. The fibers are loose fibers of either a single type or a uniform blend of multiple types of fibers. The fiber mix will determine the performance, density, texture, weight, patterning, and color of the finished pile fabric.

The fibers are typically blown together in an air chamber to blend them, and then are carded in carding machines that "comb" the fibers to align them in parallel with each other. The fibers are then gathered into a soft, thick rope which is called "sliver" (which is the derivation for the term "sliver knit") or "roving." The yarn and the sliver are supplied to the circular knitting machine, which typically has eighteen heads and produces a tubular knit pile fabric which is approximately fifty-eight inches (1473 millimeters) in circumference. (Thus, when the tubular knit pile fabric is slit longitudinally, the fabric is approximately fifty-eight inches (1473 millimeters) wide.)

Such knitting machines are well known in the art, and are illustrated in U.S. Pat. No. 3,894,407, to Clingan et al., U.S. Pat. No. 3,896,637, to Thore, U.S. Pat. Nos. 4,532,780 and 4,592,213, both to Tilson et al., U.S. Pat. Nos. 5,431,029, 5,546,768, 5,577,402, 5,685,176, and 6,016,670, all to Kukrau et al., and U.S. Pat. No. 6,151,920, to Schindler et al., all of which patents are hereby incorporated herein by reference. Examples of commercial versions of such knitting machines are the Model SK-18 II Sliver Knitter and the Model SK-18J II Sliver Knitter which are available from Mayer Industries, Inc. of Orangeburg, S.C.

The first commercial circular sliver knitting machine had seven heads, and commercially-available circular knitting machines today have between seven and eighteen heads. Eighteen head knitting machines have upwards of one thousand needles, and produce tubular knitted segments that are approximately nineteen inches (483 millimeters) in diameter (fifty-eight inches (1473 millimeters) in circumference). All of these circular sliver knitting machines produce tubular knitted pile fabric segments having the pile located on the inside. Such circular sliver knitting machines are incapable of either producing tubular knitted pile fabric segments having the pile on the outside or small diameter tubular knitted pile fabric segments.

Following the manufacture of the tubular knitted pile segments on a circular sliver knitting machine, the tubular knitted pile segments are slit longitudinally to produce extended knitted pile segments of fabric which are typically fifty-eight inches (1473 millimeters) wide by thirty to fifty yards (27.43 meters to 45.728 meters) long. These extended knitted pile segments of fabric are then tensioned longitudinally and transversely, stretched to a sixty inch (1524 millimeter) width or greater to guarantee the proper number of two and seven-eighth inch (73 millimeter) strips, and back coated (on the non-pile side of the knit base material) with a stabilized coating composition such as a clear acrylic polymer. The coating composition which is coated onto the non-pile side of the knit base material is then processed, typically by heat, to stabilize the coated, extended knitted pile segment. The heating operation dries and bonds the coating composition to the knit base material, producing a fabric which is essentially lint-free.

The coated, extended knitted pile segment can then be subjected to a shearing operation to achieve a uniform pile length, with the sheared fibers being removed by vacuum, electrostatically, or by any other known removal technique. The pile density, the nap length, and the stiffness of the fibers are varied based upon custom specifications and the particular characteristics of the paint roller cover that are desired.

The sheared, coated, extended knitted pile segment is then slit into a plurality of two and seven-eighths inch (73 millimeter) wide knitted pile fabric strips, of which there are typically twenty for a sixty inch (1524 millimeter) wide fabric segment. Following this slitting operation, the strips must be vacuumed to remove stray fibers and lint. The knitted pile fabric strips are rolled onto a core to produce twenty rolls of knitted pile fabric strips, each of which is thirty to fifty yards long. These rolls of knitted pile fabric strips may then be shipped to a paint roller cover manufacturer. Alternately, a plurality of standard lengths of the fabric may be seamed together to produce an extended length fabric strip which may be helically wound in consecutive rows upon a core as taught in U.S. Pat. Nos. 6,502,779, 6,685,121, 6,902,131, 6,918,552, and 6,929,203, all to Jelinek et al., all of which patents are hereby incorporated herein by reference.

Both the standard length rolls of knitted pile fabric strips and the rolls of extended length knitted pile fabric strips have substantial material costs and labor costs that are incurred in the manufacturing process after the circular knitting process. The material costs include the cost of the coating material, losses due to fly (fly are extra fibers that come loose from the knitted pile fabric), losses during the cutting of the sixty inch (1524 millimeter) wide fabric segment into twenty knitted pile fabric strips, and seam losses throughout the operation. The labor costs include the costs to perform the coating process, the brushing, the second pass shearing, and all of the finishing steps within the traditional sliver knit operation including slitting and continuously coiling the fabric slits.

Paint roller covers are manufactured by using a hollow cylindrical core made of cardboard or thermoplastic material which has the knitted pile fabric strip helically wound around the core. During the manufacture of paint roller covers, the knitted pile fabric strips are secured to the core either by using adhesive or epoxy, or by thermally bonding the knitted pile fabric strip in place on a thermoplastic core. For examples of these manufacturing processes see U.S. Pat. No. 4,692,975, to Garcia (the "'975 patent"), U.S. Pat. No. 5,572,790, to Sekar (the "'790 patent"), and U.S. Pat. No. 6,159,320, to Tams et al. (the "'320 patent"), each of which are hereby incorporated by reference.

The '975 patent uses a core that is cut from preformed thermoplastic (e.g., polypropylene) tubular stock. The core is mounted on a rotating spindle, and a movable carriage mounted at an angle to the spindle feeds a continuous strip of knitted pile fabric onto the core, with the carriage moving parallel to the spindle in timed relation to its rotation so that the knitted pile fabric strip is wound on the plastic core in a tight helix. Also mounted to the movable carriage is a heat source for heat softening the thermoplastic core just in advance of the point where the knitted pile fabric strip is applied to the thermoplastic core, such that the knitted pile fabric is heat bonded to the thermoplastic core as it is wound thereupon. The bond formed between the knitted pile fabric and the thermoplastic core is a strong one not subject to separation from exposure to paint solvents.

The '790 patent uses a core that is formed from a strip (or multiple strips) of thermoplastic material that is (are) helically wound about a stationary mandrel. Alternately, the core may be formed by applying liquefied thermoplastic material to a drive belt which transfers the thermoplastic material to the mandrel. A layer of adhesive is then applied to the outer surface of the core, and the knitted pile fabric strip is applied to the core by helically winding the knitted pile fabric strip onto the core. Alternately, the paint roller cover may instead be made by bonding, in a single step, a knitted pile fabric strip to a wound strip of thermoplastic material that is wrapped about the mandrel.

The '320 patent extrudes a cylindrical plastic core through a rotating extruder head that is cooled, with the outer surface of the core then being plasma treated. The knitted pile fabric strip is secured onto the plasma treated outer surface of the core by extruding thin films of first and second epoxy resin subcomponents onto the outer surface of the core as it is extruded, cooled, and plasma treated in a continuous process.

Other variations are also known, particularly in technologies relating to manufacturing pile fabric suitable for use on paint roller covers. For example, instead of using knitted pile fabric, woven pile fabric can be substituted. Woven pile fabric consists of three yarns—a knit base material or warp yarn, a filling or weft yarn, and a pile yarn. The threads of warp yarn are held taut and in a parallel array on a loom, and the threads of weft yarn are woven across the threads of warp yarn in an over/under sequence orthogonal to the threads of warp yarn, with threads of pile yarn being woven into the weave of warp and weft yarns such that the threads of pile yarn extend essentially perpendicularly from one side of the fabric. Such woven pile fabric may be processed in a manner similar to that described above with regard to the processing of knitted pile segments of fabric to produce strips of woven pile fabric that can be helically wound onto paint roller cover cores.

However, all paint roller covers manufactured using the methods described above have a seam. As the strips of fabric are helically wound around the cores, the fabric strips wrap contiguously around the core, thereby creating a helical seam that is located throughout the cover. The seam inevitably produces a less than optimal paint roller cover since a seam can interfere with the uniform application of paint from the paint roller cover. The helical winding process of manufacturing a paint roller cover requires careful attention to contiguous winding. Errors resulting in overlapped fabric or gaps in the contiguous winding process often occur, resulting in increased scrap or marketing poor quality covers. Such seams have the potential, particularly with short nap paint roller covers, to produce a seam mark or stippling effect on the surface being painted, particularly if the paint being applied combines with the seams to produce a more pronounced defective characteristic in the surface being painted.

An examination of prior technology in the paint roller cover arts reveals that this problem has been recognized in the past, with several solutions that have been proposed to deal with the challenge presented by the presence of seams in paint roller covers. The first of these, U.S. Pat. No. 2,600,955, to Barnes et al., which patent is hereby incorporated herein by reference, discloses a paint roller cover made from a segment of canvas tubing that has yarn loops sewn therethrough, with the ends of the loops on the outside of the segment of the canvas tubing being cut. This approach is certainly far too expensive to represent a viable solution, and would not compare well to currently commercially available paint roller covers in the quality of the paint coat that could be applied.

Another approach is shown in U.S. Pat. Nos. 2,704,877 and 2,752,953, both to Arnold Schmidt, which patents are hereby incorporated herein by reference, which patents are related and disclose a tubular knitted pile fabric that is stated to have been manufactured on an apparatus disclosed in U.S. Pat. No. 1,849,466, to Moore, which patent is hereby incorporated herein by reference. The apparatus disclosed in Moore, which is hand operated, was stated in several related patents to Sannipoli et al. (U.S. Pat. Nos. 2,920,372, 2,944,588, and 3,010,867, which patents are hereby incorporated herein by reference) to be capable of manufacturing a seamless tubular knitted sleeve in which the pile is located on the interior of the sleeve, thereby requiring that the sleeve be inverted prior to mounting it on a core to form a paint roller cover. As such, the apparatus disclosed in Moore is incapable of manufacturing a knitted sleeve in which the pile is located on the exterior of the sleeve.

The Sannipoli et al. patents inverted the tubular knitted sleeve by positioning it within a hollow tube and pulling one end of the tubular knitted sleeve around the end of the tube and pushing successive portions of the tubular knitted sleeve along the outside of the tube. The Arnold Schmidt '877 patent (which failed to disclose how it inverted the knitted sleeve with the pile on the interior thereof) disclosed a machine for treating and shearing inverted tubular knitted sleeves, and the Arnold Schmidt '953 patent disclosed using the inverted, treated, and sheared tubular knitted sleeves by stretching them and pulling them over a tube or shell to form a paint roller.

The problem that has prevented the inventions of the Arnold Schmidt patents and the Sannipoli et al. patents from being either practical or commercially successful is that the process of inverting a tubular knitted sleeve having the pile on the interior of the sleeve inevitably damages the fabric of the tubular knitted sleeve. When the fabric is inverted, the material of the fabric is deformed due to stretching that occurs during the process of inverting the tubular knitted sleeve. This deformation tends to increase the diameter of the tubular knitted sleeve, thus requiring it to be stretched lengthwise to restore it to its former diameter. Not only is this process difficult and expensive, but it also results in variable density of the fabric as well as introducing the prospect of adhesive or thermoplastic bleed-through within the stitches. Such problems will result in unacceptable product quality in paint roller covers made from this type of fabric.

It has been determined that the inverting approach taught by the Sannipoli et al. patents and useable by the Arnold Schmidt patents has three drawbacks that make it impracticable. The first drawback of the inverting method is that it requires a high degree of manual operation in that it requires cutting of the tubular knitted sleeves to size and placement of the tubular knitted sleeves into the tubes of the inverting machine. The second drawback of the Sannipoli et al. method is that only relatively short length tubular knitted sleeves representing a single paint roller cover (typically nine inches (229 millimeters)) can be processed at a time, which makes the method inherently unsuitable for mass production.

The third, and by far the most serious, drawback of the Sannipoli et al. method is that the process of inverting the tubular knitted sleeves inevitably results in stretching the tubular knitted sleeves so that they will not snugly fit on the paint roller cover cores, potentially creating creases in a high percentage of them when they are adhesively secured to the paint roller cover cores. This results in an unacceptably high percentage of them being defective and necessitating them being scrapped, resulting in an unacceptably high scrap cost. Predictably, the inventions taught in the Sannipoli et al. patents and the Arnold Schmidt patents have never found commercial acceptance due to these serious disadvantages.

The above-incorporated by reference U.S. patent application Ser. No. 11/740,119 discloses a tubular sliver knitted pile fabric which is manufactured with the sliver pile side facing outwardly rather than inwardly and with a diameter suitable for mounting on a paint roller cover core in a seamless manner. While the tubular knitted pile fabric in this patent application is disclosed as being for installation onto a core member, the method used to install the tubular knitted pile fabric onto the outer surface of the core member is not disclosed.

While this tubular sliver knitted pile fabric has been found to be quite satisfactory, it was recognized that it would also be desirable to provide an alternative tubular pile fabric which has a cut-pile made of yarn rather than sliver fibers The above incorporated by reference, commonly assigned, and co-pending U.S. patent application Ser. No. 12/116,022 provides a tubular cut-pile knit paint roller cover fabric suitable for use in the manufacture of a paint roller cover. A cut-pile knit paint roller cover fabric, in accordance with co-pending U.S. patent application Ser. No. 12/116,022 is manufactured with the pile side facing outwardly rather than inwardly, thereby obviating the need to invert it prior to mounting it on a paint roller cover core. A cut-pile knit paint roller cover fabric, in accordance with co-pending U.S. patent application Ser. No. 12/116,022 can have a size suitable for mounting on a paint roller cover core in a seamless manner, without cutting except to a length fitting the length of paint roller cover core material on which the cut-pile knit paint roller cover fabric is to be mounted.

A cut-pile knit paint roller cover fabric, in accordance with U.S. patent application Ser. No. 12/116,022 can also be provided in a form that is suitable for use in its application on a paint roller cover without experiencing any significant degradation of the cut-pile knit paint roller cover fabric due to its contact with a wide variety of paints, enamels, stains, etc. A cut-pile knit paint roller cover fabric, in accordance with U.S. patent application Ser. No. 12/116,022 can further be provided in a form in which the pile loops are securely retained by the knit base material such that the shedding of pile fibers from the cut-pile knit paint roller cover fabric is minimized. In a cut-pile knit paint roller cover fabric, in accordance with U.S. patent application Ser. No. 12/116,022, the cut-pile knit paint roller cover fabric is manufacturable in extended length segments that may later be cut to tubular segments of any desired length.

A cut-pile knit paint roller cover fabric, in accordance with U.S. patent application Ser. No. 12/116,022 can further be of construction which is both durable and long lasting when it has been secured to a paint roller cover core, and the resulting paint roller cover should provide the user with an acceptably long lifetime. A cut-pile knit paint roller cover fabric, in accordance with U.S. patent application Ser. No. 12/116,022 is inexpensive to manufacture, thereby affording broad market appeal. Finally, a cut-pile knit paint roller cover fabric, in accordance with U.S. patent application Ser. No. 12/116,022, provides all of the aforesaid advantages without incurring any substantial relative disadvantage.

Having successfully provided tubular knit paint roller cover fabric in co-pending U.S. patent application Ser. No. 11/740,119 having an outwardly extending pile formed entirely from sliver fibers, and having successfully provided tubular knit paint roller cover fabric in co-pending U.S. patent application Ser. No. 12/116,022 having an outwardly extending pile formed entirely of cut-pile fibers, it is desirable to provide a tubular knit paint roller cover having courses of outwardly extending pile formed entirely of sliver fibers successively alternating with courses of outwardly extending pile formed entirely of cut-pile fibers. Given the substantial differences in the knitting processes utilized for forming tubular knit paint roller cover fabric having an outwardly extending pile formed entirely from sliver fibers, as disclosed in co-pending U.S. patent application Ser. No. 11/740,119, as compared to the knitting processes utilized for forming tubular knit paint roller cover fabric having an outwardly extending pile formed entirely of cut-pile fibers, as disclosed in co-pending U.S. patent application Ser. No. 12/116,022, the challenges to be surmounted in providing a tubular knit paint roller cover having courses of outwardly extending pile formed entirely of sliver fibers successively alternating with courses of outwardly extending pile formed entirely of cut-pile fibers are significant.

It is accordingly the primary objective of the present invention that it provide a tubular knit paint roller cover fabric having alternating courses of sliver fiber pile and cut-pile suitable for use in the manufacture of a paint roller cover. It is a related principal objective of the present invention that the tubular knit paint roller cover fabric having alternating courses of sliver fiber pile and cut-pile be manufactured with the pile side facing outwardly rather than inwardly, thereby obviating the need to invert it prior to mounting it on a paint roller cover core. It is an additional related principal objective of the present invention that the tubular knit paint roller cover fabric having alternating courses of sliver fiber pile and cut-pile be of a size suitable for mounting on a paint roller cover core in a seamless manner, without cutting except to a length fitting the length of paint roller cover core material on which the cut-pile knit paint roller cover fabric is to be mounted.

It is also an objective of the present invention that the tubular knit paint roller cover fabric having alternating courses of sliver fiber pile and cut-pile be suitable for use in its application on a paint roller cover without experiencing any significant degradation of the cut-pile knit paint roller cover fabric due to its contact with a wide variety of paints, enamels, stains, etc. It is a further objective of the present invention that the tubular knit paint roller cover fabric having alternating courses of sliver fiber pile and cut-pile be manufactured in a manner in which the pile loops are securely retained by the knit base material such that the shedding of pile fibers from the cut-pile knit paint roller cover fabric is minimized. It is a still further objective of the present invention that the tubular knit paint roller cover fabric having alternating courses of sliver fiber pile and cut-pile be manufacturable in extended length segments that may later be cut to tubular segments of any desired length.

The tubular knit paint roller cover fabric having alternating courses of sliver fiber pile and cut-pile of the present invention must also be of construction which is both durable and long lasting when it has been secured to a paint roller cover core, and the resulting paint roller cover should provide the user with an acceptably long lifetime. In order to enhance the market appeal of the tubular knit paint roller cover fabric having alternating courses of sliver fiber pile and cut-pile of the present invention, it should also be inexpensive to manufacture to thereby afford it the broadest possible market. Finally, it is also an objective that all of the aforesaid advantages and objectives of the tubular knit paint roller cover fabric having alternating courses of sliver fiber pile and cut-pile of the present invention be achieved without incurring any substantial relative disadvantage.

SUMMARY OF THE INVENTION

The present invention meets the above defined objectives by providing a tubular knit fabric suitable for use on paint roller covers having an outwardly extending pile formed from a plurality of cut-pile segments and tufts of sliver knit fabric disposed in alternating successive courses in the knit pile fabric.

In one form of the invention, a knit pile fabric suitable for use on paint roller covers, includes a knitted base fabric having a tubular configuration defining an outside and an inside, said base fabric having a predetermined number of wales located adjacent each other and arranged around the circumference of said base fabric. The base fabric has successive courses, each of which is knit after a preceding course, with the base fabric including a plurality of loops, and each loop in any particular wale being knitted through a loop in the preceding course in said particular wale from the outside to the inside of said tubular configuration of said base fabric. The pile is formed partly from a plurality of cut-pile segments, each having opposite ends with a loop portion located therebetween. The loop portion of each of the plurality of cut-pile segments is knitted together with a loop of the base fabric into the base fabric, in such a manner that opposite ends of the plurality of cut-pile segments extend outwardly from the base fabric and form a part of the pile of the knit fabric. The pile is also formed partly from a plurality of tufts of sliver fibers, with each of the tufts of sliver fibers having opposite ends with a loop portion located therebetween. The loop portion of each of the plurality of tufts of sliver fibers is knitted together with a loop of the base fabric into the base fabric in such a manner that the opposite ends of the plurality of tufts of fibers extend outwardly from the base fabric and form a portion of the pile of the knit pile fabric. The plurality of cut-pile segments and the plurality of tufts of sliver knit fabric are disposed in alternating successive courses in the knit pile fabric.

The disadvantages and limitations of the background art discussed above are overcome by the present invention. With this invention, a knit fabric having alternating courses of sliver fiber pile and cut-pile is provided that has several key characteristics that radically differentiate it from prior knit fabrics. The first and most important of these differentiating factors is that the knit paint roller fabric having alternating courses of sliver fiber pile and cut-pile of the present invention is manufactured in a tubular segment with the pile located on the outside of the tubular knit paint roller fabric having alternating courses of sliver fiber pile and cut-pile rather than on the inside, in this manner obviating the need to invert the tubular knit paint roller fabric having alternating courses of sliver fiber pile and cut-pile and thereby deform the tubular knit paint roller fabric having alternating courses of sliver fiber pile and cut-pile. The second key differentiating factor is that the tubular knit paint roller fabric having alternating courses of sliver fiber pile and cut-pile of the present invention is manufactured in a size that makes it appropriate for installation onto paint roller cover cores, which typically have an inner diameter of approximately one and one-half inches (38 millimeters) and an outer diameter of approximately one and five-eighths inches (41 millimeters) to one and three-quarters inches (44 millimeters).

The tubular knit paint roller fabric having alternating courses of sliver fiber pile and cut-pile in one form of the present invention has a knitted base material that is knit in a single jersey circular knitting process on a radically redesigned circular knitting machine that is designed to produce the tubular knit paint roller fabric having alternating courses of sliver fiber pile and cut-pile of the present invention. The jersey knitted knit base material of the tubular knit paint roller fabric having alternating courses of sliver fiber pile and cut-pile of the present invention has a plurality of courses (which are rows of loops of stitches which run across the tubular knit paint roller fabric having alternating courses of sliver fiber pile and cut-pile (around the circumference of the tubular knit paint roller fabric having alternating courses of sliver fiber pile and cut-pile)) and a plurality of wales (which are vertical chains of loops in the longitudinal direction of the tubular knit paint roller fabric having alternating courses of sliver fiber pile and cut-pile). The number of wales together with the gauge (the number of courses per circumferential inch) determines the diameter of the tubular knit paint roller fabric having alternating courses of sliver fiber pile and cut-pile of the present invention. In the tubular knit paint roller fabric having alternating courses of sliver fiber pile and cut-pile of the present invention, the number of wales can vary between approximately forty and one hundred wales, with the currently preferred embodiment having approximately fifty wales.

In alternating courses, the knitting of the stitches of the knit base material is used to anchor tufts of sliver fibers, and also to anchor loops of pile yarn which are cut, with the free ends of the pile loops extending from the outer side of the knit base material of the tubular knit paint roller fabric having alternating courses of sliver fiber pile and cut-pile of the present invention. As the tubular knit paint roller fabric having alternating courses of sliver fiber pile and cut-pile of the present invention is knit, the length of the sliver fibers and the height of the outermost ends of the cut-pile loops may be varied to product longer or shorter pile, and will typically vary between approximately one-quarter inch (6.35 millimeters) and three inches (76 millimeters).

The tubular knit paint roller fabric having alternating courses of sliver fiber pile and cut-pile of the present invention may be manufactured in extended lengths, which may be cut to the desired lengths subsequent to its manufacture. Notably, the tubular knit paint roller fabric having alternating courses of sliver fiber pile and cut-pile of the present invention does not require inverting since the pile is located on the outside. It will be appreciated by those skilled in the art that the tubular knit paint roller fabric having alternating courses of sliver fiber pile and cut-fiber pile of the present invention does not require slitting since it is produced to fit over paint roller cover cores rather than to be wound helically around paint roller cover cores. Thus, all of the post-knitting material and labor costs mentioned above with reference to the manufacture of standard or extended length rolls of knitted pile fabric strips are not incurred in the manufacturing of the tubular knit paint roller fabric having alternating courses of sliver fiber pile and cut-pile of the present invention.

The tubular knit paint roller fabric having alternating courses of sliver fiber pile and cut-fiber pile of the present invention may be cut to single paint roller length (typically nine inches (229 millimeters)), or it may be cut to fit a longer length paint roller cover core segment, such as, for example, sixty-four inches (1625 millimeters). Following application of the longer length paint roller cover core segment to the longer length paint roller cover core segment, it may be cut into smaller paint roller covers, such as, for example, seven nine inch (229 millimeter) paint roller covers. Alternately, the extended paint roller cover segments may be manufactured at the same facility manufacturing the tubular knit paint roller fabric having alternating courses of sliver fiber pile and cut-fiber pile, with the extended paint roller cover segments being shipped to a paint roller manufacturer for finishing.

Finishing either the cut-to-length paint roller covers or the extended paint roller cover segment may include combing the tubular knit paint roller fabric having alternating courses of sliver fiber pile and cut-fiber pile on the paint roller cover and shearing the fabric having alternating courses of sliver fiber pile and cut-fiber pile on the paint roller cover. These finishing steps may occur either before or after cutting the paint roller covers to the desired length. Finally, the edges of the paint roller covers are beveled, and any loose pile fibers may be vacuumed off. The finishing of extended paint roller cover segments may be performed using the MBK Maschinenbau GmbH paint roller finishing machine distributed by Roller Fabrics, an Edward Jackson (Engineer) Limited finishing machine, or other equipment custom built by individual paint roller manufacturers.

The tubular knit paint roller fabric having alternating courses of sliver fiber pile and cut-fiber pile of the present invention may be mounted onto a paint roller cover core in any desired manner. Different ways of adhering the tubular knit paint roller cover having alternating courses of sliver fiber pile and cut-pile onto a paint roller cover core may be used as desired. The tubular knit paint roller fabric having alternating courses of sliver fiber pile and cut-fiber pile of the present invention is suitable for paint roller cover cores made according to any of a variety of ways.

It may therefore be seen that the present invention provides a tubular knit paint roller fabric having alternating courses of sliver fiber pile and cut-fiber pile that is suitable for use in the manufacture of a paint roller cover. The tubular knit paint roller fabric having alternating courses of sliver fiber pile and cut-fiber pile of the present invention is manufactured with the pile side facing outwardly rather than inwardly, thereby obviating the need to invert it prior to mounting it on a paint roller cover core. The tubular knit paint roller fabric having alternating courses of sliver fiber pile and cut-fiber pile of the present invention is of a size suitable for mounting on a paint roller cover core in a seamless manner, without cutting it except for cutting it to a length fitting the length of paint roller cover core material on which the tubular knit paint roller fabric having alternating courses of sliver fiber pile and cut-fiber pile is to be mounted.

The tubular knit paint roller cover fabric having alternating courses of sliver fiber pile and cut-fiber pile of the present invention is well suitable for use in its application on a paint roller cover, and will not experience any significant degradation of the tubular cut-pile knit paint roller cover fabric due to its contact with a wide variety of paints, enamels, stains, etc. The tubular knit paint roller cover fabric having alternating courses of sliver fiber pile and cut-fiber pile of the present invention is manufactured in a manner in which the pile loops are securely retained by the knit base material such that the shedding of pile fibers from the tubular knit paint roller cover fabric having alternating courses of sliver fiber pile and cut-fiber pile is minimized. The tubular knit paint roller fabric having alternating courses of sliver fiber pile and cut-fiber pile of the present invention is also manufacturable in extended length segments that may later be cut to tubular segments of any desired length.

The tubular knit paint roller fabric having alternating courses of sliver fiber pile and cut-fiber pile of the present invention is of a construction which is both durable and long lasting when it has been secured to a paint roller cover core, and the resulting paint roller cover will provide the user with an acceptably long lifetime. The tubular knit paint roller fabric having alternating courses of sliver fiber pile and cut-fiber pile of the present invention is also inexpensive to manufacture, thereby enhancing its market appeal and to affording it the broadest possible market. Finally, all of the aforesaid advantages and objectives of the tubular knit paint roller fabric having alternating courses of sliver fiber pile and cut-fiber pile of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
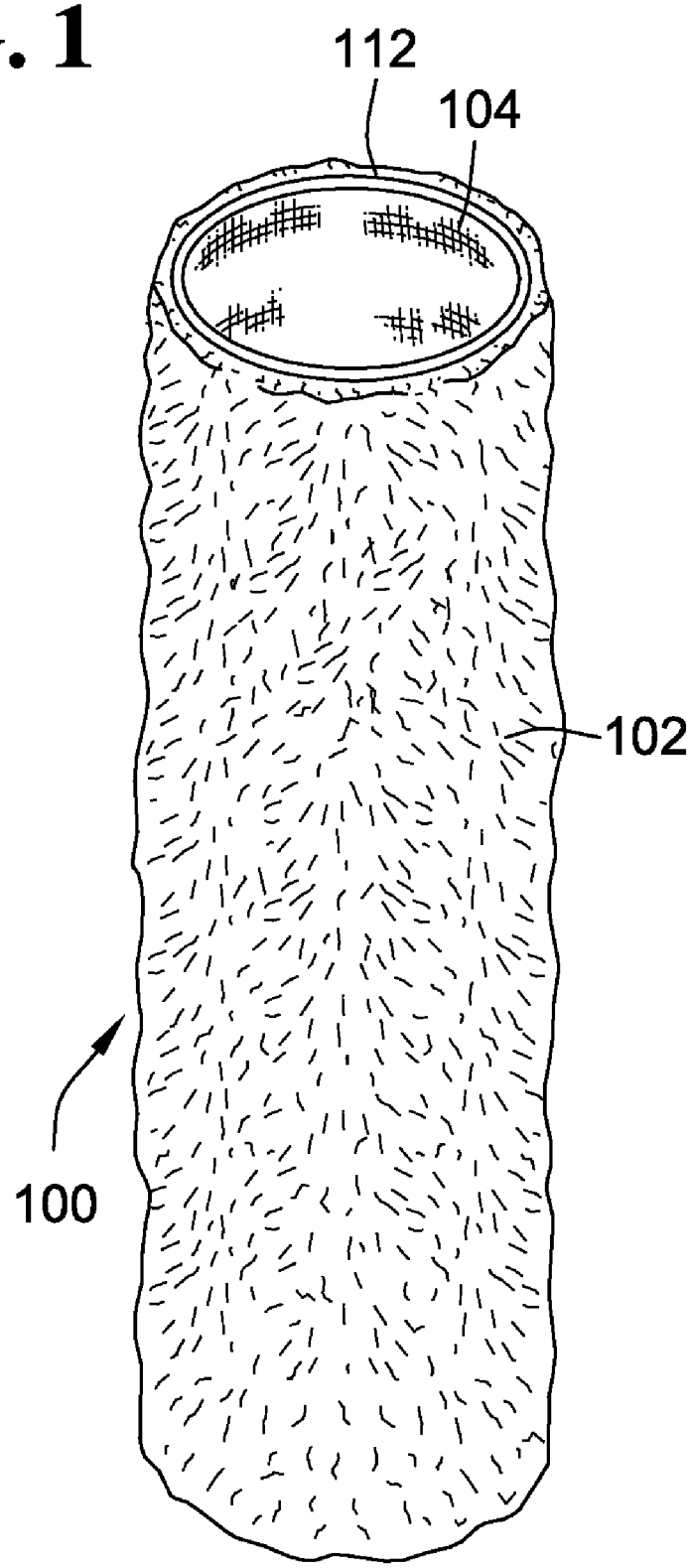
FIG. 1 is an isometric view of a segment of tubular cut-pile knit paint roller fabric made according to the teachings of the present invention with the cut-pile extending outwardly, showing a tubular knit base having cut-pile segments extending outwardly therefrom.
Figures 2, 3, 4:
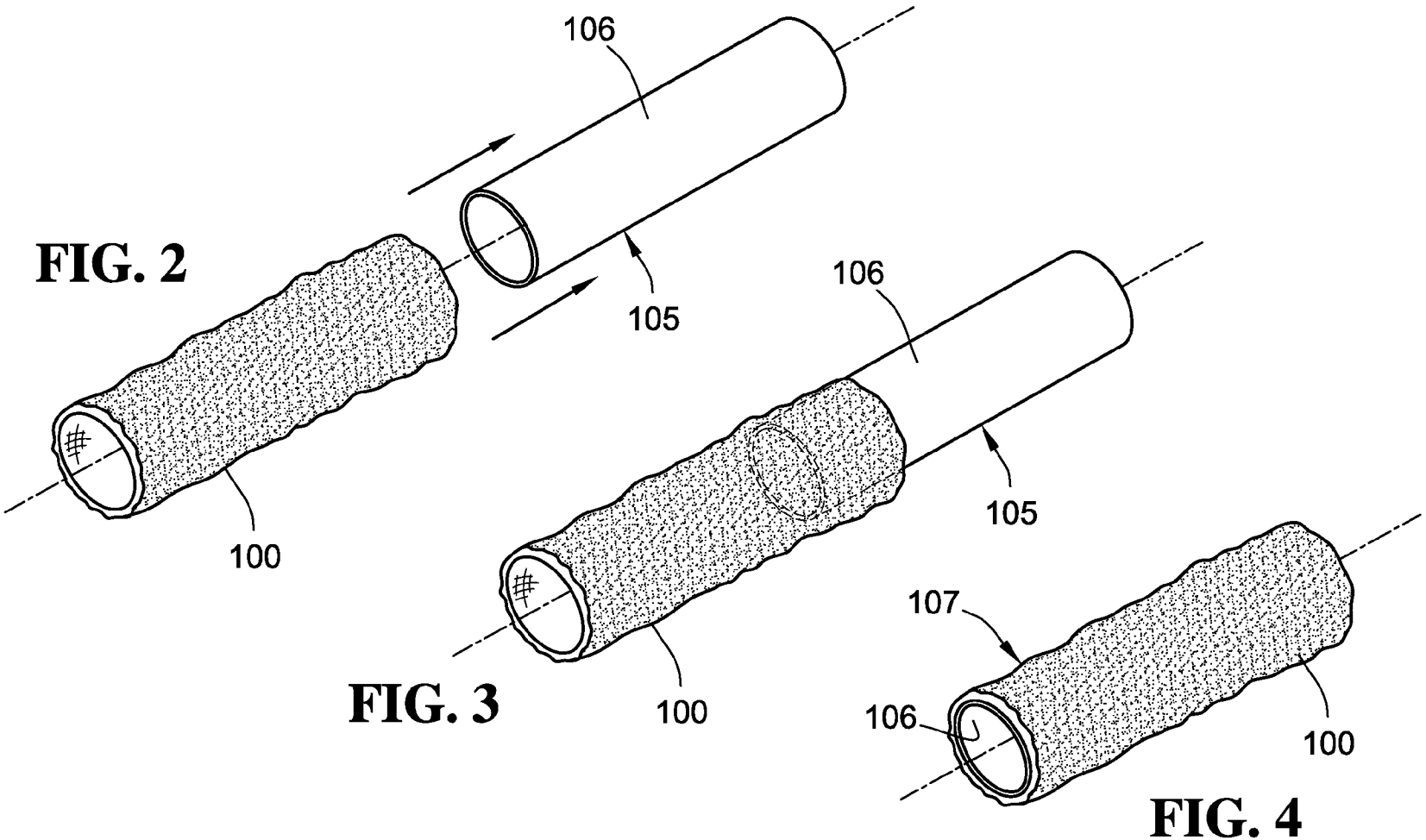
FIG. 2 is a schematic isometric depiction showing an end of a tubular paint roller cover fabric illustrated in FIG. 1 about to be slid onto the outer surface of a core member over an adhesive located on the outer surface of the core member.
FIG. 3 is a schematic isometric depiction of the tubular paint roller cover fabric and the adhesive-covered core member shown in FIG. 2, with the tubular paint roller cover fabric being partially slid onto the outer surface of the core member.
FIG. 4 is a schematic isometric depiction of the tubular paint roller cover fabric and the adhesive-covered core member shown in FIGS. 3 and 4, with the tubular paint roller cover fabric now covering the entire outer surface of the adhesive-covered core member.

FIG. 1 shows a first exemplary embodiment of a tubular-shaped knitted covering 100 for a paint roller having pile fibers 102 made up of alternating courses of sliver fiber pile and cut-pile extending from a lightweight knit backing or base material 104, that is knitted according to one of the methods and using an apparatus of the type disclosed in commonly assigned U.S. patent application Ser. No. 11/871,307 and in commonly assigned U.S. patent application Ser. No. 12/249,455. As will be readily understood by those having skill in the art, the tubular knit segment 100, having a pile 102 made up of alternating courses of sliver fiber pile and cut-pile, may be readily pulled over and affixed to a core 106 by an adhesive 105, as illustrated in FIGS. 2-4, to form a completed roller cover 107 according to one of the methods shown in the inventor's commonly assigned U.S. patent application Ser. Nos. 11/740,119, 12/015,612, 12/100,050, 12/132,774, or another appropriate manner, without the necessity for resorting to helically wrapping a strip of pile fabric about the core as was required in prior roller covers.

Figure 5:
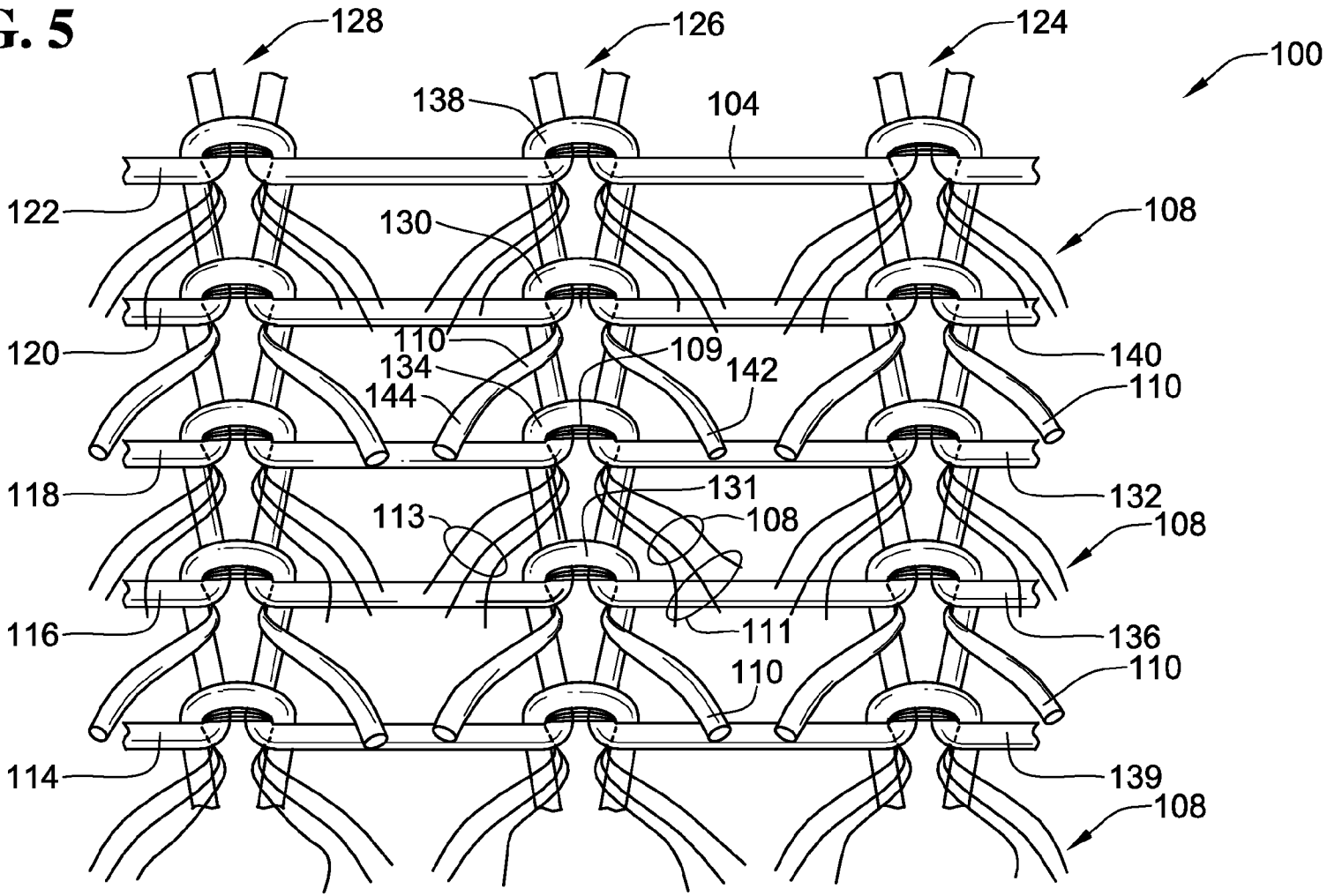
FIG. 5 is a schematic view of a portion of the tubular paint roller fabric illustrated in FIG. 1 from the outside, showing the knitting pattern of the base yarn and the placement of cut-pile segments into the knit base.

Referring next to FIG. 5, a segment of the tubular knit segment 100 having a pile 102 made up of alternating courses of sliver fiber pile and cut-pile is shown in schematic form, from the outside thereof, to illustrate the knit of the knit base material 104, and the manner in which tufts of sliver fiber 108 and loops of cut-pile fiber 110 are woven into the knit base material 104 to form the pile 102 made up of alternating courses of sliver fiber pile and cut-pile. Those skilled in the art will at once realize that while the tufts 111 of the sliver fiber 108 shown in FIG. 5 include only a few fibers each for added clarity and understanding of the construction of the pile fabric 20, tufts 111 of sliver fibers 108 in the pile 102 of the tubular sliver knit segment 100 will actually include sufficient sliver pile fibers 108 to help form a pile 102 that is sufficiently dense for the intended use of the tubular shaped knit segment 100 in the manufacture of a paint roller cover 107.

The preferred embodiment of the knit paint roller fabric having alternating courses of sliver fiber pile and cut-pile of the present invention produces a tubular knit paint roller fabric segment 100, having alternating courses of sliver fiber pile and cut-pile, as shown in FIG. 1 that may be continuously knitted in an extended length. It may be seen from a top edge 112 of the knit base material 104 that the tubular knit segment 100 has an essentially circular cross section. The tubular knit segment 100 may be knitted in as long a length as desired, notwithstanding that FIG. 1 only shows a relatively short segment of the tubular knit segment 100.

Figure 6:
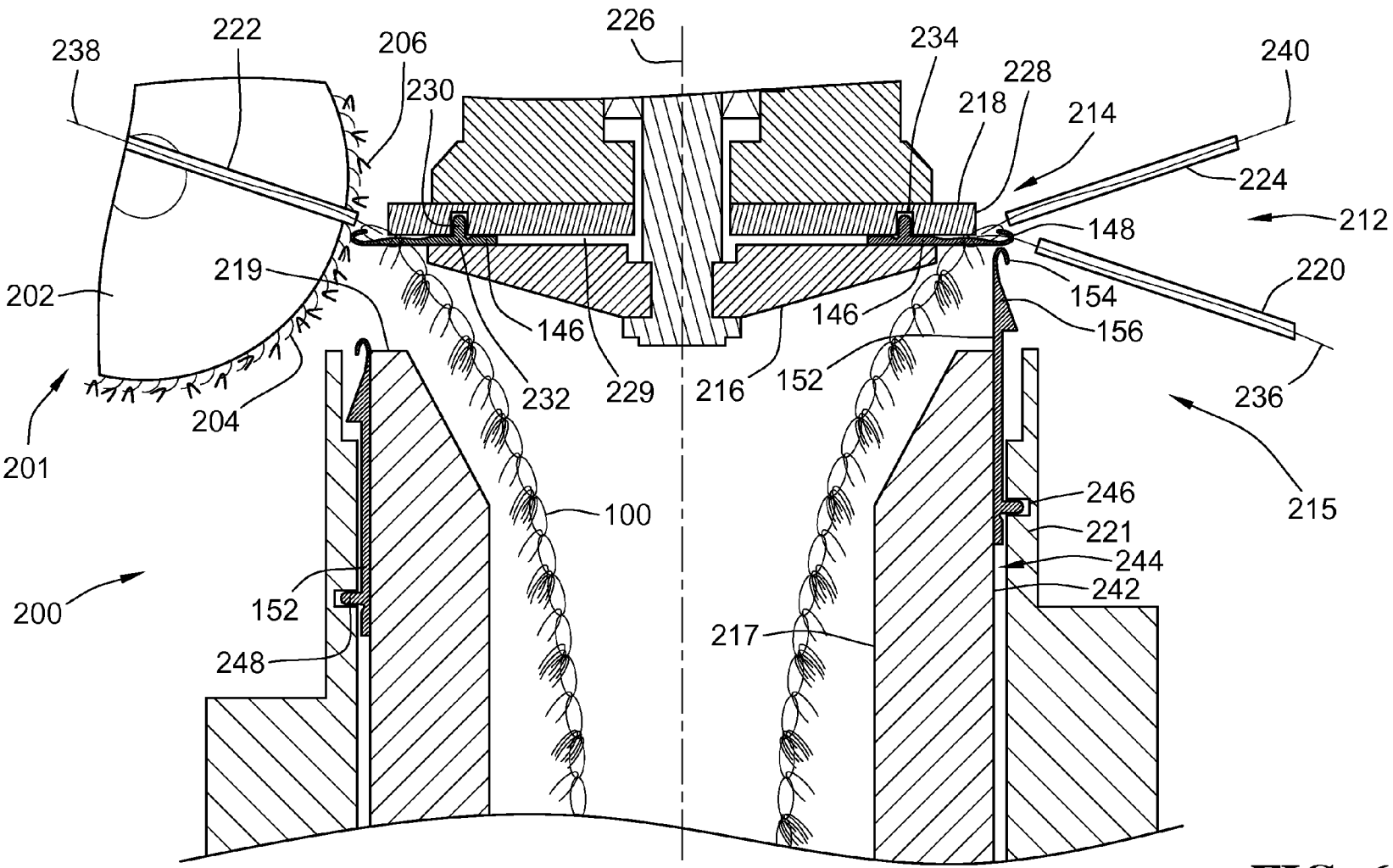
FIG. 6 is a schematic cross-sectional illustration of an exemplary embodiment of a knitting machine configured for knitting a tubular knit fabric having a pile extending from an outer side thereof with the pile having cut-pile and sliver pile segments disposed in alternating courses of the tubular knit fabric.
Figure 7:
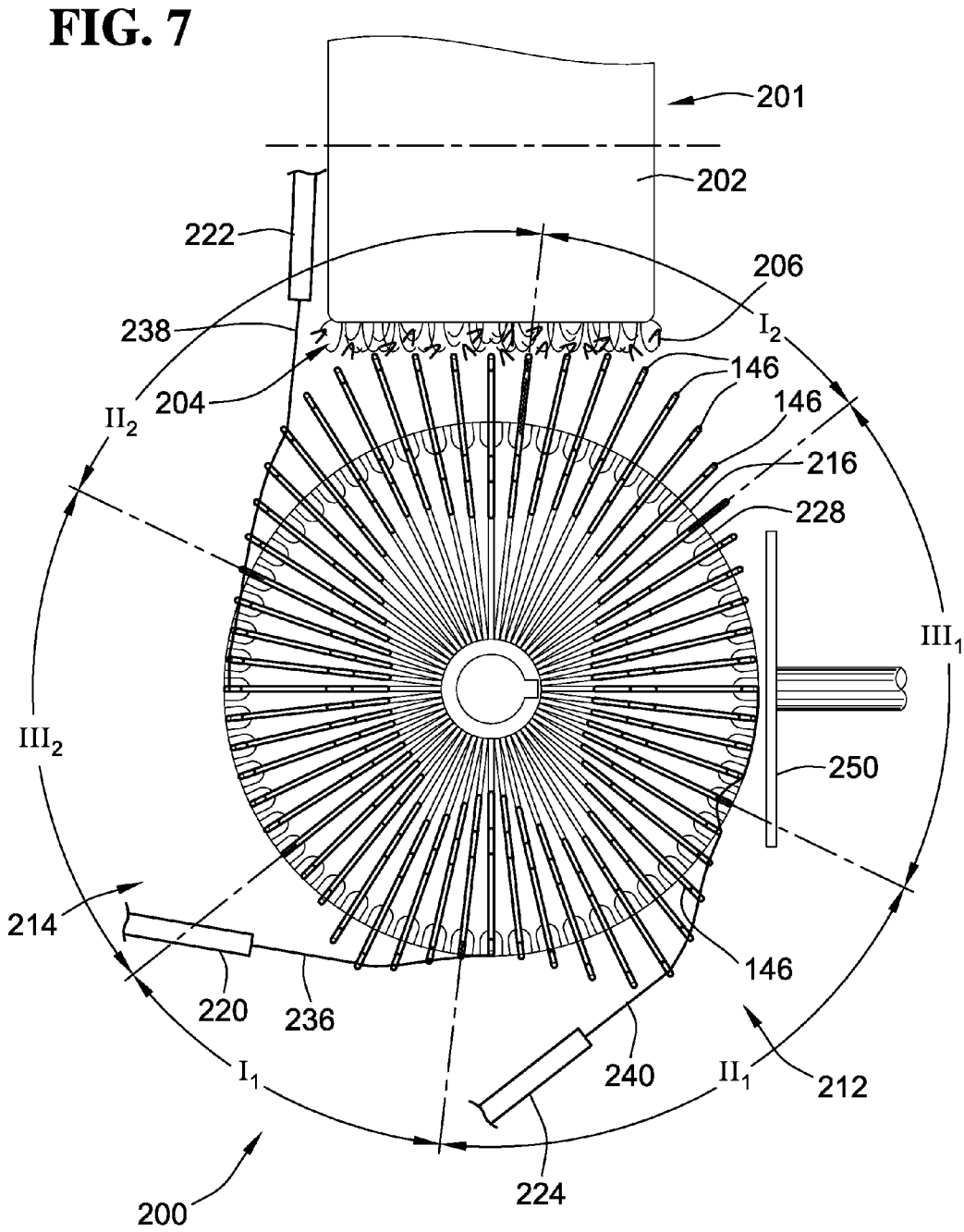
FIG. 7 is a schematic illustration of portions of the knitting machine shown in FIG. 6, further illustrating the manner of knitting a tubular fabric having a pile extending from an outer surface thereof with alternating courses of the pile being made from sliver fibers and cut-pile fibers, in accordance with the invention.

The tubular knit segment 100 having a pile 102 made up of alternating courses of sliver fiber pile and cut fiber pile may be knit in a highly modified single jersey circular knitting process on a radically redesigned circular knitting machine of the type generally indicated schematically in an exemplary embodiment of a knitting machine 200 in FIGS. 6 and 7. The construction and operation of an embodiment of a circular knitting machine of the type illustrated in FIGS. 6 and 7 is also described in considerably greater detail in commonly assigned U.S. patent application Ser. Nos. 11/871,307 or 12/249,455, the disclosures of which are incorporated herein in their entireties.

The exemplary embodiment of the knitting machine 200, shown herein in FIGS. 6 and 7, is specifically configured for forming the tubular-shaped knitted roller covering 100, as shown in FIGS. 1 and 5, having multiple successively disposed knitted courses including pile on the outside of the covering. The knitting machine 200 is configured for simultaneously knitting two adjacent courses with the pile material being sliver fibers in one course of the two simultaneously knitted courses and the pile material being a single strand of face yarn in the other course of the two simultaneously knitted courses.

As shown in FIGS. 6 and 7, this is accomplished by configuring the knitting apparatus 200 to include one doffer-type sliver fiber pile feeding apparatus 201, and one pile yarn feeding apparatus 212. Knitting and forming the face yarn pile course is accomplished using the pile yarn feeding apparatus 212, in three stages $I_1$, $II_1$, $III_1$, about substantially the lower right half (as shown in FIG. 7) of a dial 216 of the knitting machine 200, in the manner described in more detail below. In similar fashion, knitting and forming the pile yarn pile course is accomplished using the sliver fiber pile feeding apparatus 201, in three stages $I_2$, $II_2$, $III_2$, about substantially the upper left half (as shown in FIG. 7) of a dial 214 of the knitting machine 200.

As shown in FIGS. 6 and 7, the first exemplary embodiment of a knitting apparatus 200, for forming the tubular-shaped knitted covering 100 for a paint roller, or the like, having a pile 102 extending from an outer surface of the covering includes a dial knitting arrangement 214, having: a dial 216; a plurality of dial needles 146 operatively disposed in the dial 216; a dial cam box 218 disposed adjacent to the dial 216 and operatively connected to the dial needles 146; first and second backing yarn feeding arrangements 224, 222; a pile yarn feeding arrangement 220; all operatively mounted on a frame (not shown) and driven through a drive arrangement (not shown).

The frame defines a main vertical axis of rotation 226, about which the dial 216 rotates.

The knitting arrangement 200 also includes a cylinder knitting arrangement 215, having: a cylinder 217 having an upper end 219; a cylinder cam box 221 disposed outwardly adjacent the cylinder 217, and a plurality of cylinder needles 152. The cylinder needles 152 are operatively disposed in the cylinder 217 and connected to the cylinder cam box 221 in such a manner that the cylinder needles 152 move in a direction substantially parallel to the vertical main axis of rotation 226 as the cylinder 217 is rotated about the axis 226 in a synchronized fashion with the dial 216.

As best seen in FIG. 7, the dial 216 has a periphery 228 thereof, which is substantially circular in the exemplary embodiment of the dial 216, and disposed about the main vertical axis of rotation 226. As shown in FIGS. 6 and 7, the dial 216, in the exemplary embodiment of the knitting apparatus 200, also has 56 substantially radially directed dial needle slots 229 opening in an upward direction, with each dial needle slot 229 being configured for slidably receiving one of the dial needles 146.

As best seen in FIG. 6, the dial cam box 218 is non-rotatably mounted to the frame closely adjacent the dial 216. The dial cam box 218 includes a downwardly-facing and opening dial cam box cam track 230 therein.

The dial needles 146 each have a body 232 thereof disposed in a respective dial needle slot 229. Each of the dial needles 146 also has a hooked end 148 that is outwardly extendable beyond the periphery 228 of the dial 216, and a needle cam lobe 234 extending upward beyond the dial needle slot 229 and into sliding engagement with the dial cam box needle track 230, in such a manner that rotation of the dial 216 causes the dial needles 146 to be selectively moveable radially within the dial needle slots 229 through interaction of the dial needle cam lobes 234 with the dial needle cam track 230. Each dial needle 146 also includes a latch 150 (see FIG. 8) pivotably attached to the body 232 of the needle 146 adjacent the hooked end 148, and operable in the manner illustrated in FIGS. 8 through 27 and described in detail below.

As schematically illustrated in FIGS. 6 and 7, the backing yarn and pile feeding arrangements 220, 222, 224 are operatively disposed adjacent the periphery 228 of the dial 216, and adapted for feeding first and second backing yarns 240, 238, a pile yarn 236 and pile sliver fibers 108 to the dial needles 146, along selected segments of the periphery 228 of the dial 216, in such a manner that an extended length of tubular-shaped knitted covering 100 for a paint roller having a pile 102 extending from an outer surface of the covering 100 may be knitted with the first exemplary embodiment of the knitting apparatus 200, according to the method laid out in detail below with reference to FIGS. 8 through 25.

As shown in FIG. 6, the cylinder needle knitting arrangement 215 includes the cylinder 217, a plurality of cylinder needles 152 operatively disposed in the cylinder 217. The cylinder 217 has a radially outer periphery 242 thereof, disposed about the axis of rotation 226, and having a plurality of substantially axially directed needle slots 244 opening in a radially outward direction and also in an upward direction at the upper end 219 of the cylinder 217.

The cylinder cam box 221 is non-rotatably mounted to the frame and includes a radially inward facing and opening cylinder needle cam track 246 therein.

As further shown in FIG. 7, the cylinder needles 152 each have a body thereof which is disposed in a respective cylinder needle slot 244 of the plurality of cylinder needle slots 244, and a hooked end 154 that is upwardly extendable beyond the upper end 219 of the cylinder 217. Each of the cylinder needles 152 also includes a cylinder needle cam lobe 248 which extends radially outward beyond the cylinder needle slot 244 and into sliding engagement with the cylinder needle cam track 246, such that rotation of the cylinder 217 causes the cylinder needles 152 to be selectively moveable axially within the cylinder needle slots 244 through interaction of the cylinder needle cam lobes 248 with the cylinder needle cam track 246. By virtue of this arrangement, the cylinder 217 and dial 216 and their respective dial and cylinder needles 146, 152 are operatively connected for synchronized rotation with respect to one another about the axis of rotation 226.

It will be further noted, that the cylinder needles 152 each include a cutting blade portion 156 disposed adjacent the hooked end 154 of the needle 152 rather than having the pivoting latches 150 (see FIG. 8) of the dial needles 146.

Figure 18:
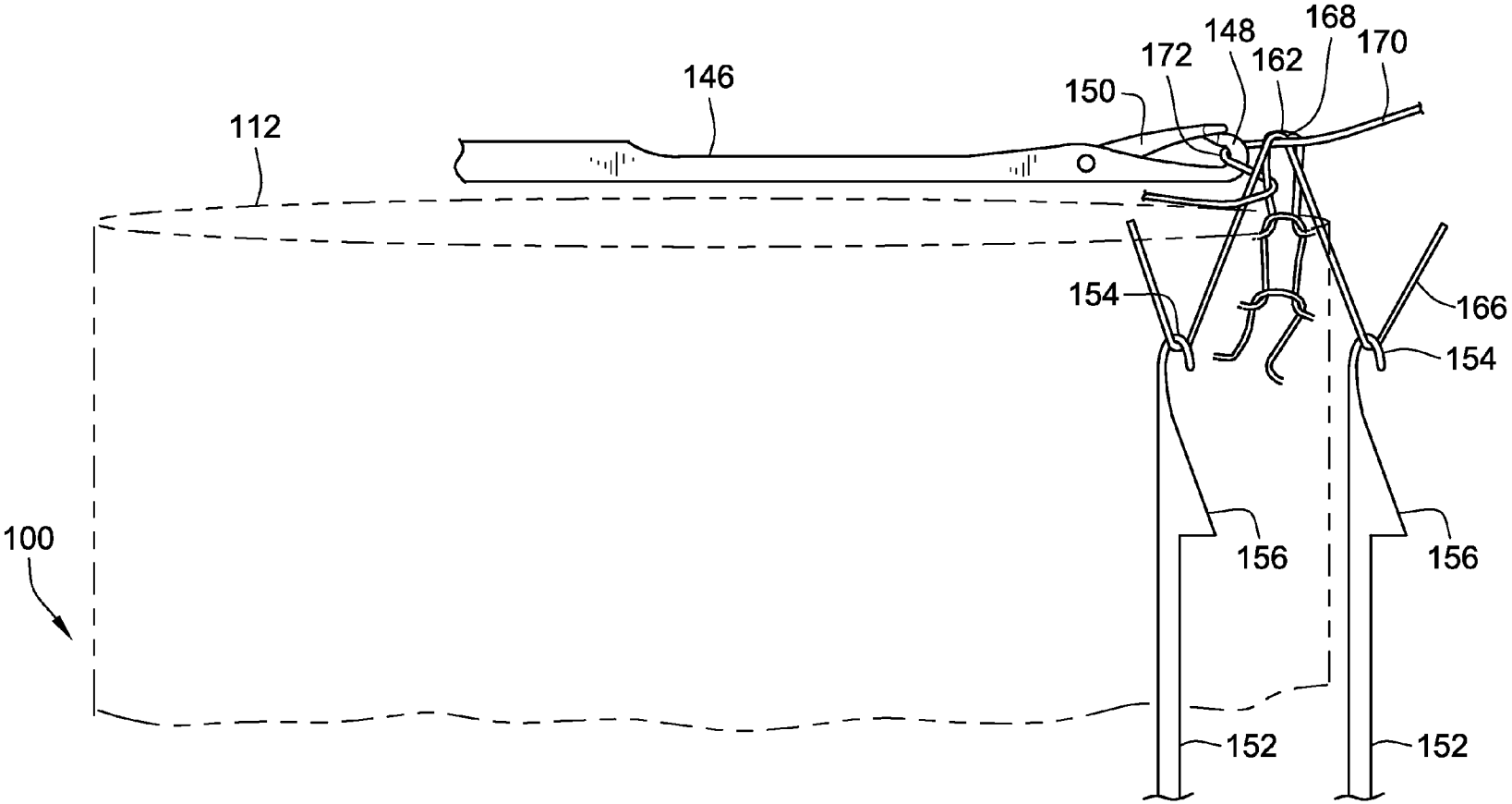
FIG. 18 is a schematic view of the knitting needle and the tubular paint roller fabric shown in FIGS. 8 through 17, with the dial needle in its fully proximal direction and with the new pile loop and the old backing loop having been cast off and the new backing loop having been formed, with the cylinder needles remaining in their fully downward position retaining the lower portions of the new pile loop.
Figure 19:
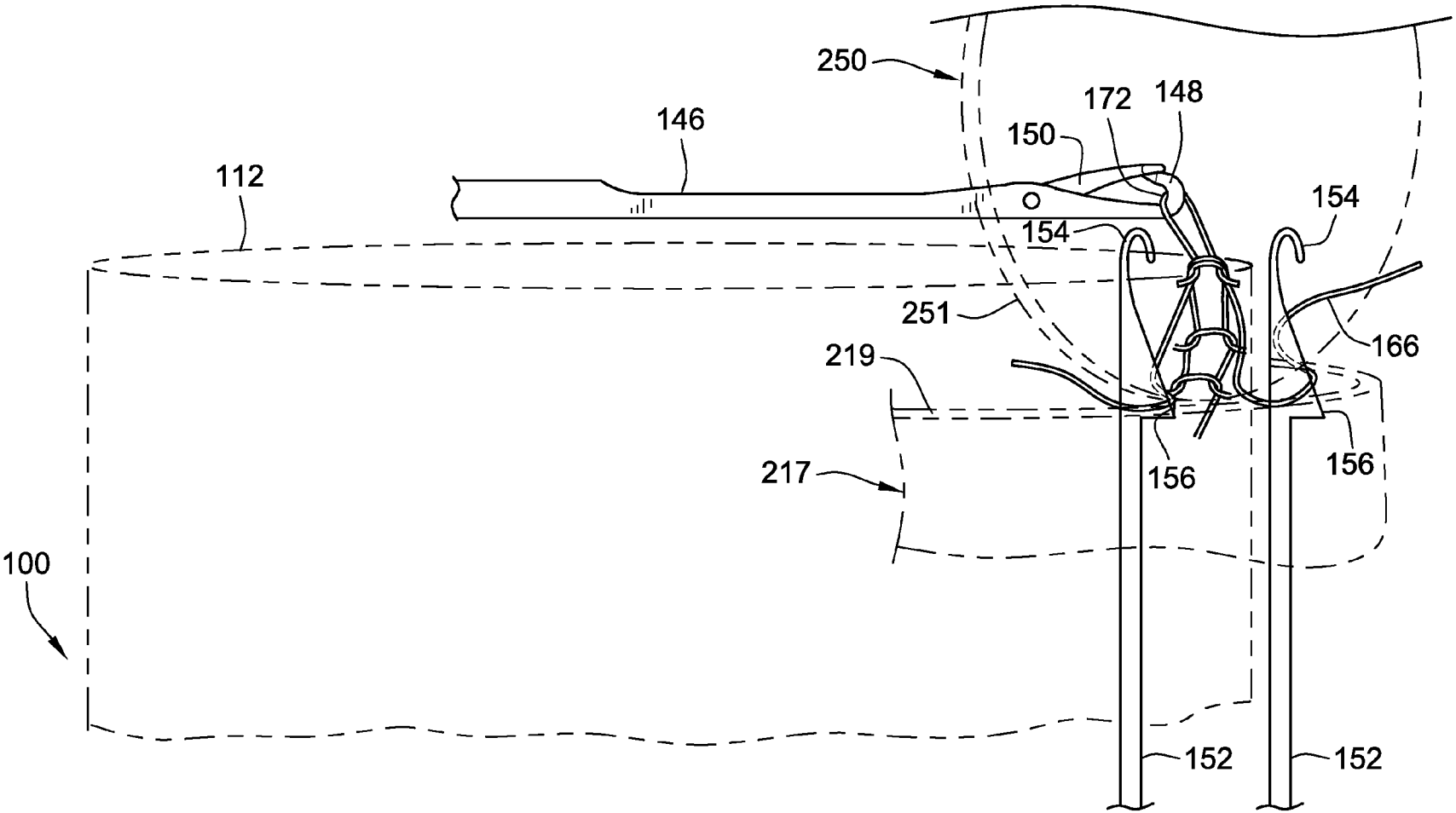
FIG. 19 is a schematic view of the dial needle and the cylinder needles and the tubular paint roller fabric shown in FIGS. 8 through 18, with the dial needle remaining in its resting position and a cutting wheel engaging the top edge of a cylinder to pinch the pile yarn forming the ends of the new pile loop therebetween as the cylinder needles move upward to cut the new pile loop.

As shown in FIGS. 7 and 19, the cylinder needle knitting arrangement 215 also includes a pile yarn cutting wheel 250, for use in a manner described in greater detail below, for assisting in cutting of the pile yarn 236 into pile fibers as they are knitted in place in successive alternating courses of the backing yarn 240 in the manner described in detail below with reference to FIGS. 8 through 25.

As shown in FIG. 5, the foundation of the exemplary embodiment of the tubular knit segment 100 having a pile 102 made up of alternating courses of sliver fiber pile and cut fiber pile is the knit base material 104. The knit base material 104 has a plurality of courses (which are rows of loops of stitches which run across the knit fabric), five of which are shown and designated by the reference numerals 114, 116, 118, 120 and 122, and a plurality of wales (which are vertical chains of loops in the longitudinal direction of the knit fabric), three of which are shown and designated by the reference numerals 124, 126 and 128. The respective courses 114, 116, 118, 120 and 122 are knitted sequentially from the lowest course number to the highest course number.

By way of example, to illustrate the manner in which the courses of looped fiber cut-pile 110 are knitted, the construction of the portion of the tubular knit segment 100 in the area of the course 120 and the wale 126 will be discussed herein. A backing loop 130 formed in a backing yarn segment 132 is located in this area, with a backing loop 134 formed in a backing yarn segment 136 being located in the course 116 below the backing loop 130, and a backing loop 138 formed in a backing yarn segment 140 being located in the course 122 above the backing loop 130. The backing loop 130 extends through the backing loop 134 from the outside to the inside of the tubular knit segment 100 (shown in FIG. 1), and the backing loop 138 also extends through the backing loop 130 from the outside to the inside. It will at once be appreciated by those skilled in the art that this arrangement of backing loops in sequentially knitted courses is completely opposite to the way in which knit fabrics have been knitted on known circular knitting machines.

A cut-pile segment 110 having a pile loop portion 143 and opposite pile ends 142 and 144 is knitted into the knit base material 32 together with the backing loop 130. The pile loop portion 143 of that particular cut-pile segment 110 is located adjacent the top of the backing loop 130, and the opposite pile ends 142 and 144 of that particular cut-pile segment 110 extend outwardly from the interior of the backing loop 130, above the backing loop 134 and below the backing loop 138. In a similar manner, each of the other cut-pile segments 110 is knitted into the knit base material 104 with a different backing loop.

FIGS. 8 through 20 illustrate a cut-pile knitting process which may be used to knit the courses of the tubular segment 100 having cut fiber pile loops 110, as shown in FIG. 5, for example. These figures show in sequential fashion how a stitch is formed. Each of these figures shows a dial needle 146 having a hook 148 located at the distal end thereof and a latch 150 that has a proximal end that is pivotally mounted at a location on the dial needle 146 that is proximal of the hook 148. The latch 150 can pivot between a closed position (shown in FIGS. 8, 12, 17, 18, 19, and 20) in which the distal end of the latch 150 contacts the end of the hook 148 to form an enclosed area with the hook 148, and an opened position (shown in FIGS. 10, 14, and 20) in which the distal end of the latch 150 forms a small acute angle with the proximal end of the dial needle 146. FIGS. 9, 11, 13, and 16 show the latch 150 in intermediate positions.

Each of FIGS. 8 through 20 also shows two cylinder needles 152 that are respectively located below and on opposite sides of the distal end of the dial needle 146. The cylinder needles 152 each have a hook 154 located at the distal end thereof, and a tapered cutting edge 156 located a short distance from the hook 154. The tapered cutting edge 156 is coplanar with the hook 154, and extends outwardly progressively further as it extends further from the hook 154. The dial needle 146 and the cylinder needles 152 are oriented essentially orthogonally to each other.

FIGS. 8 through 20 show the tubular cut-pile knit segment 100 in phantom lines, with only several backing loops in a single wale being shown in solid lines. Specifically, sequential backing loops 158, 160 and 162 are shown in each of FIGS. 8 through 20, with the backing loops 158, 160 and 162 being in courses that are knitted sequentially from the course containing the lowest backing loop number to the course containing the highest backing loop number. It may be seen that the wales and courses containing the backing loops 158 and 160 already have cut-pile loops 110 and sliver fiber tufts 108 respectively knitted therein. The knitting process shown in FIGS. 8 through 20 shows the knitting of a new pile loop 168 into the wale and course containing the backing loop 162 as well as the knitting of a new backing loop 172 in a new course being knit above (and thereby in the same wale as) the backing loop 162.

Note that in each of FIGS. 8 through 20, the dial needle 146 is generally located inside the tubular cut-pile knit segment 100 with its distal end (the end with the hook 148) extending from the interior of the tubular cut-pile knit segment 100 radially outwardly. Thus, movement of the dial needle 146 in a proximal direction is defined as movement radially inwardly with respect to the tubular cut-pile knit segment 100, and movement of the dial needle 146 in a distal direction is defined as movement radially outwardly with respect to the tubular cut-pile knit segment 100. The dial needle 146 is oriented such that the latch 150 pivots upwardly and the opening defined by the hook 148 is located above the tubular cut-pile knit segment 146, and the movement of the dial needle 146 is radial with respect to the tubular cut-pile knit segment 100. Those skilled in the art will at once appreciate that the location, orientation, and movement of the dial needle 146 is radically different from the location, orientation, and movement of needles in currently known circular pile knitting machines. (The needles in currently known circular pile knitting machines are oriented essentially parallel to the axis of the tubular segment being knit, with the hooks of the needles located above the top end of the tubular segment being knit.)

Note also that in each of FIGS. 8 through 20, the cylinder needles 152 are located outside the tubular cut-pile knit segment 100 and are oriented in essentially parallel fashion to the longitudinal axis of the tubular cut-pile knit segment 100 with their distal ends (the ends with the hooks 154) extending upwardly at locations near the top edge 112 of the tubular cut-pile knit segment 100. Thus, movement of the cylinder needles 152 in a proximal direction is defined as movement upwardly with respect to the top edge 112 of the tubular cut-pile knit segment 100, and movement of the cylinder needles 152 in a distal direction is defined as movement downwardly with respect to the top edge 112 of the tubular cut-pile knit segment 100. The cylinder needles 152 are oriented such that the tapered cutting edge 156 and the opening defined by the hook 154 are located away from the tubular cut-pile knit segment 100, and the movement of the cylinder needles 152 is up and down parallel to the longitudinal axis of the tubular cut-pile knit segment 100. Those skilled in the art will at once appreciate that the location, orientation, and movement of the cylinder needles 152 is radically different from the location, orientation, and movement of needles in currently known circular pile knitting machines.

The knitting process that is schematically illustrated in FIGS. 8 through 20 may be thought of as comprising three stages, as indicated by arcs $I_1$, $II_1$ and $III_1$, in FIG. 7. In the first stage of the knitting process, shown in FIGS. 8 through 15, a new pile loop is knitted into the tubular cut-pile knit segment 100. During this first stage $I_1$, both the dial needles 146, and cylinder needles 152 are utilized to creating the new pile loop from pile yarn 240. In the second stage $II_1$ of the knitting process, shown in FIGS. 13 through 18, a new backing loop is knitted into the tubular cut-pile knit segment 100. During this second stage, only the dial needles 152 move in creating the new backing loops from backing yarn 236, with the cylinder needles 152 remaining stationary. In the third stage $III_1$ of the knitting process, shown in FIGS. 19 and 20, the new pile loop 110 is cut to form a cut-pile loop 110 by the tapered cutting edges 156 of the cylinder needles 152. During this third stage $III_1$, only the cylinder needles 152 are utilized to cut the new pile loop 110 free from the pile yarn 240, with the dial needle 146 remaining stationary.

Figure 8:
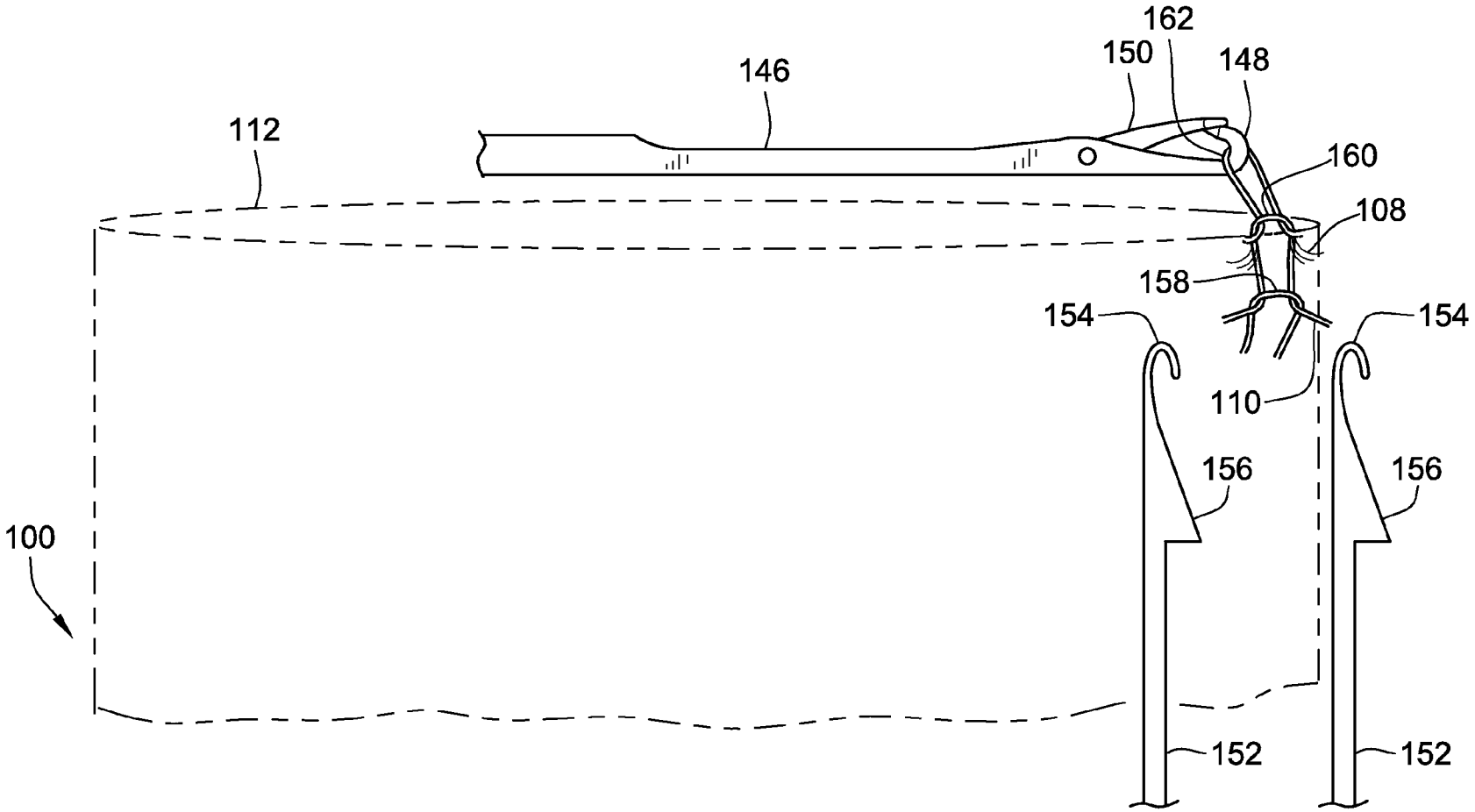
FIG. 8 is a schematic view of a knitting dial needle having a hook located at the distal end thereof and a latch pivotally mounted at a position proximal from the hook, also showing two knitting cylinder needles located on opposite sides of the dial needle, the dial needle and the cylinder needles being used to knit a course made up of sliver fibers in a tubular paint roller fabric similar to the one illustrated in FIGS. 1 and 5, with the dial needle being in a resting position with regard to an old backing loop on the dial needle and the cylinder needles being in their fully downward position.

As mentioned above, the first stage $I_1$ of the knitting process is shown in FIGS. 8 through 12. Referring first to FIG. 8, the dial needle 146 is shown in its fully proximal or resting position, with the backing loop 162 engaged by the hook 148 of the dial needle 146 (near the distal-most end of the dial needle 146) and with the latch 150 in its closed position with the distal end of the latch 150 adjacent the distal end of the hook 148. The cylinder needles 152 are each shown in their fully proximal or resting position.

Figure 9:
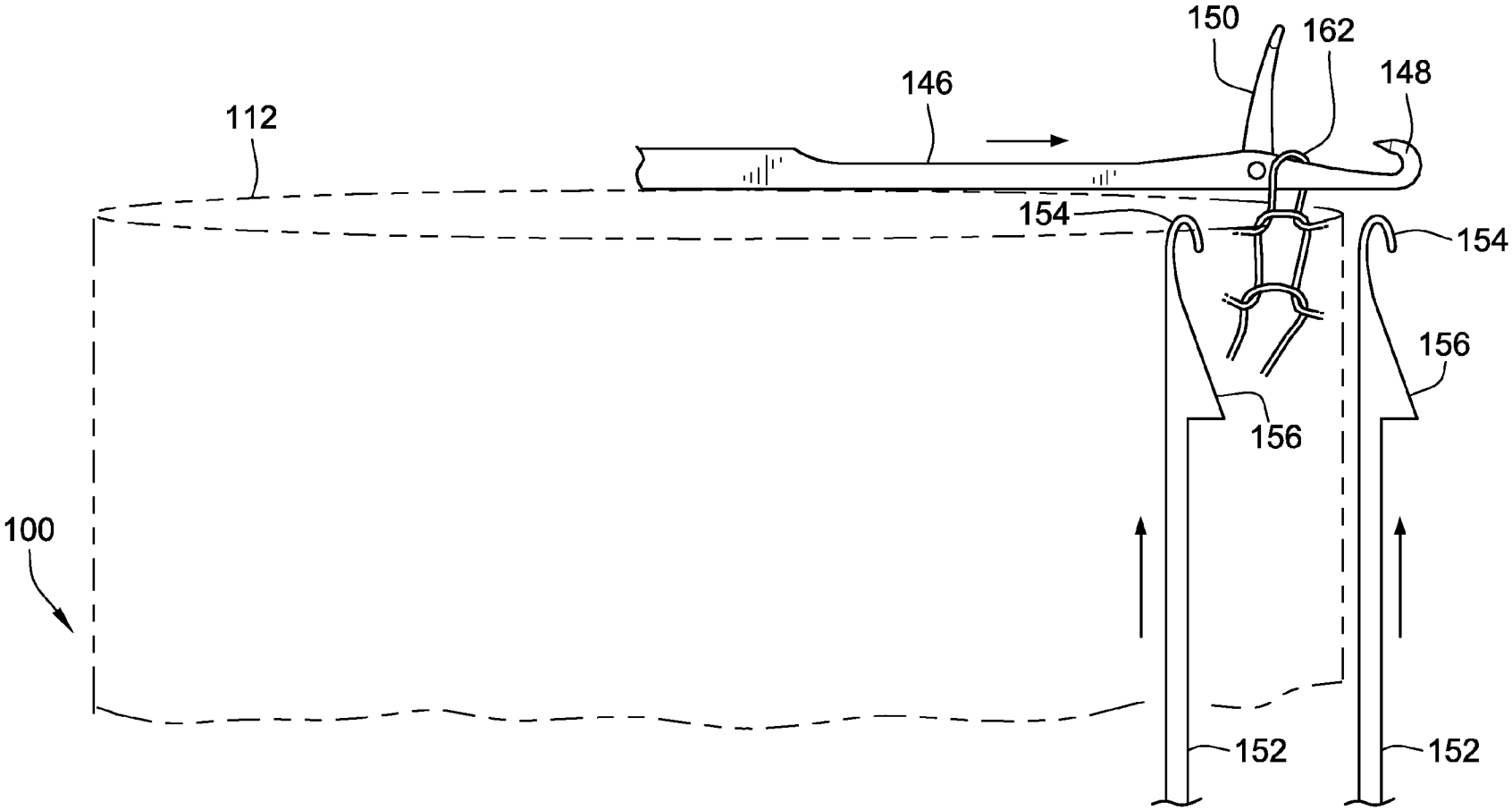
FIG. 9 is a schematic view of the dial needle and the cylinder needles and the tubular paint roller fabric shown in FIG. 8, with the dial needle moving in a distal direction and the old backing loop beginning to open the latch of the dial needle, and the cylinder needles moving in an upward direction.

Referring next to FIG. 9 in contrast with FIG. 8, it may be seen that the dial needle 146 has moved in a distal direction, and the backing loop 162 has begun to open the latch 150, causing the latch 150 to move to a position approximately midway between its closed and opened positions. Note that the backing loop 162 is adjacent the proximal end of the latch 150. Simultaneously, the cylinder needles 152 have also begun to move in a distal (upward) direction.

Figure 10:
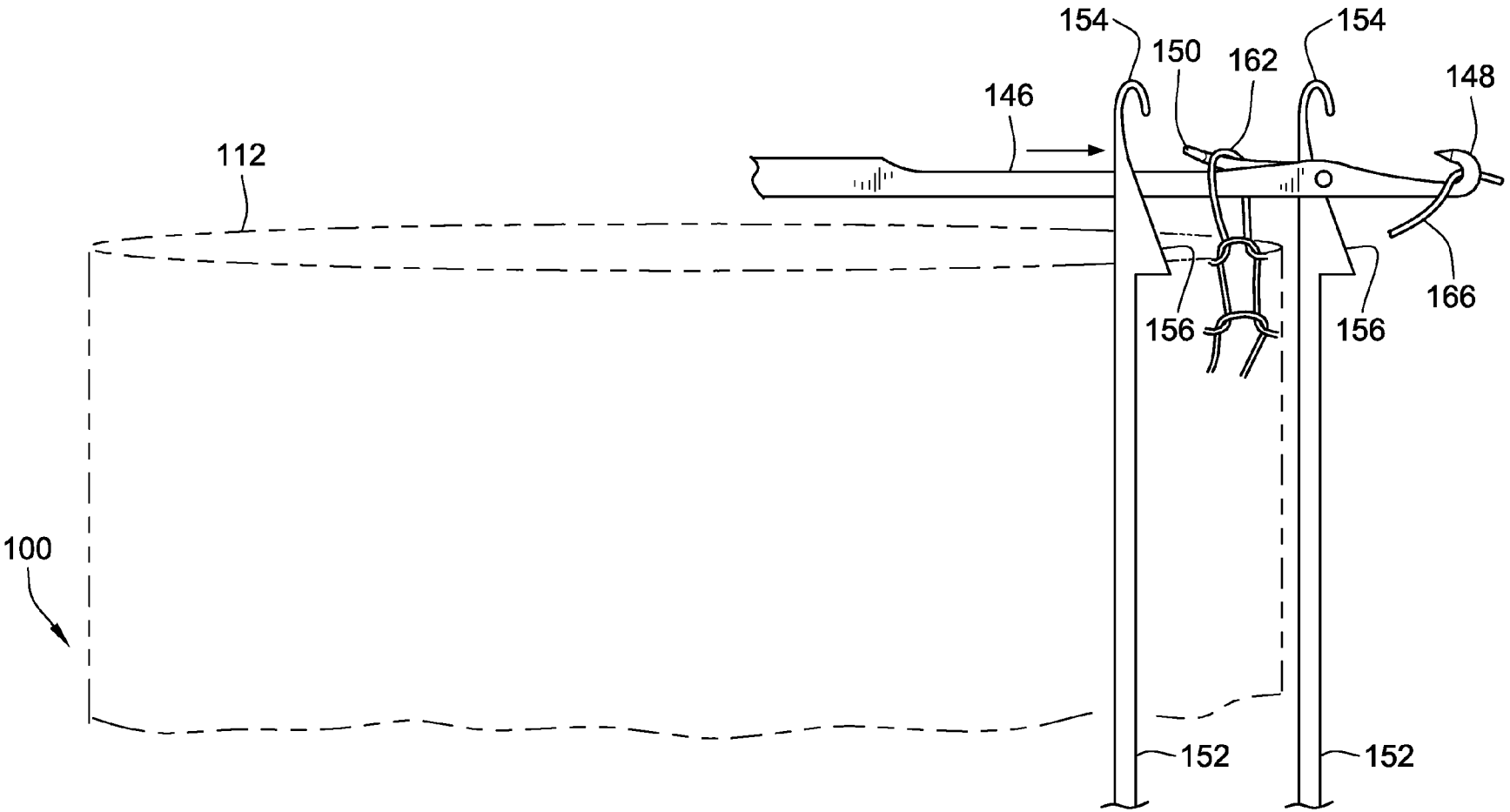
FIG. 10 is a schematic view of the dial needle and the cylinder needles and the tubular paint roller fabric shown in FIGS. 8 and 9, with the latch on the dial needle being in a tuck position with the old backing loop being located on the latch, the cylinder needles being in their fully upward position, with the hook of the dial needle capturing the pile yarn.

Referring next to FIG. 10 in contrast with FIG. 9, it may be seen that the dial needle 146 has continued to move in a distal direction to its tuck position, and the backing loop 162 is located nearly at the distal end of the latch 150, causing the latch 150 to move to its opened position. The cylinder needles 152 have moved into their fully distal (upward) or tuck position, where their hooks 154 are located above the dial needle 146 (by approximately 5.0 mm to 8.0 mm). When the dial needle 146 and the cylinder needles 152 are in their respective tuck positions, pile yarn 166 (also referred to as "face yarn") is inserted into the hook 148 of the dial needle 146.

Figure 11:
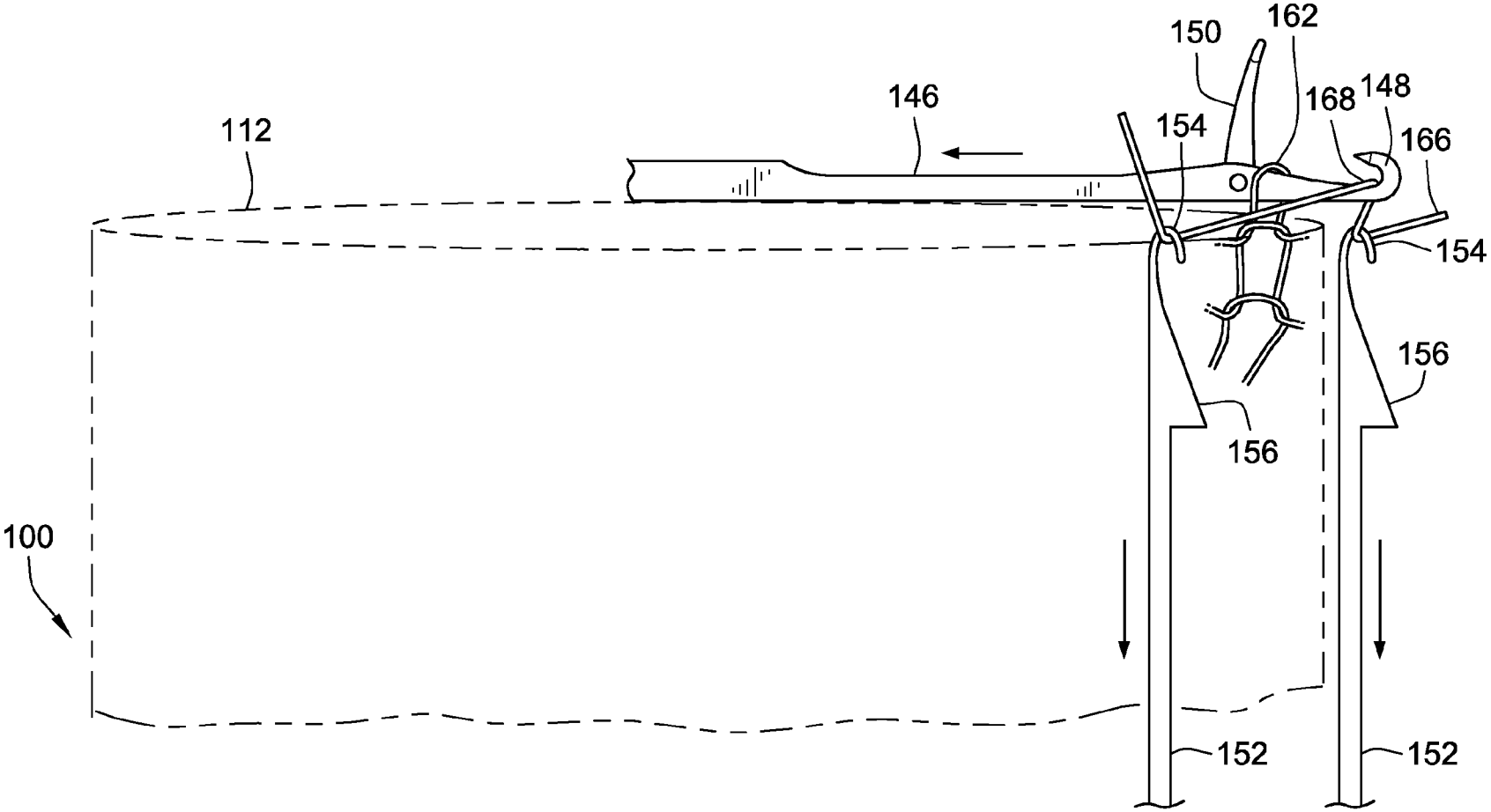
FIG. 11 is a schematic view of the dial needle and the cylinder needles and the tubular paint roller fabric shown in FIGS. 8 through 9, with the dial needle moving in a proximal direction and the cylinder needles moving in a downward direction, with the hooks of the dial needle and the cylinder needles capturing the pile yarn to form a new pile loop extending from the dial needle, and with the latch of the dial needle being closed by the old backing loop and the new pile loop as the dial needle moves in the proximal direction.

Referring next to FIG. 11 in contrast with FIG. 10, it may be seen that the dial needle 146 has moved in a proximal direction, pulling the pile yarn 166 into contact with the cylinder needles 152 just below their respective the hooks 154. As this occurs, the cylinder needles 152 begin to move downward, with the hooks 154 of the cylinder needles 152 drawing the pile yarn 166 downward on both sides of the dial needle 146, thereby beginning to create a new pile loop 168.

Figure 12:
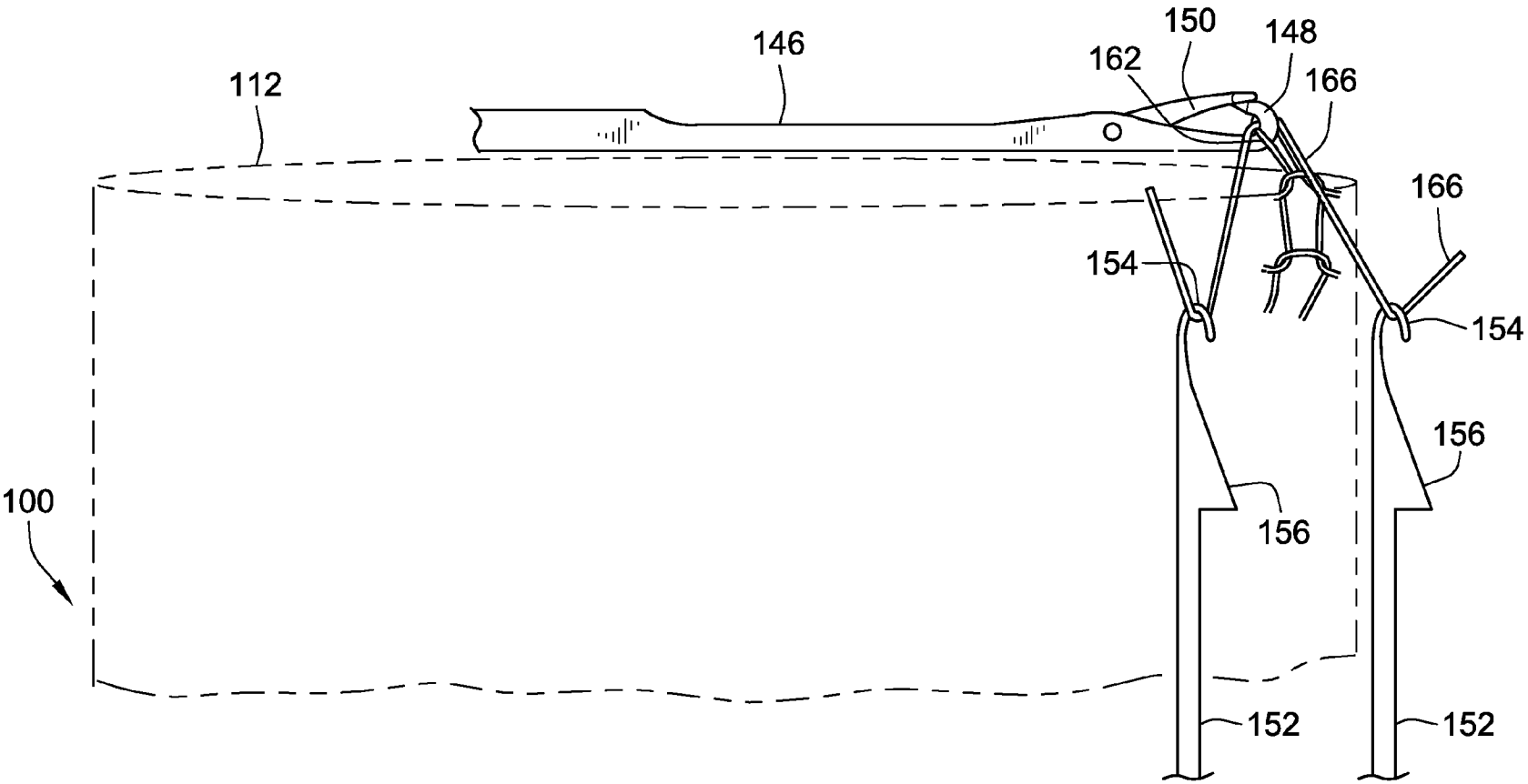
FIG. 12 is a schematic view of the dial needle and the cylinder needles and the tubular paint roller fabric shown in FIGS. 8 through 11, with the dial needle being in its resting position with regard to the old backing loop and the new pile loop thereupon and the cylinder needles being in their fully downward position to fully form the lower portions of the new pile loop.

Referring next to FIG. 12 in contrast with FIG. 11, it may be seen that the dial needle 146 has returned to its fully proximal or resting position, and the cylinder needles 152 have returned to their fully proximal or resting positions. Both the backing loop 162 and the new pile loop 168 are engaged by the hook 148 of the dial needle 146 (near the distal-most end of the dial needle 146) and the latch 150 is in its closed position with the distal end of the latch 150 adjacent the distal end of the hook 148. It should be noted that the length of the new pile loop 168 may be adjusted by raising or lowering the fully proximal or resting positions of the cylinder needles 152. This completes the first stage of the knitting process, and is the starting point for the second stage of the knitting process, which is shown in FIGS. 13 through 18.

Figure 13:
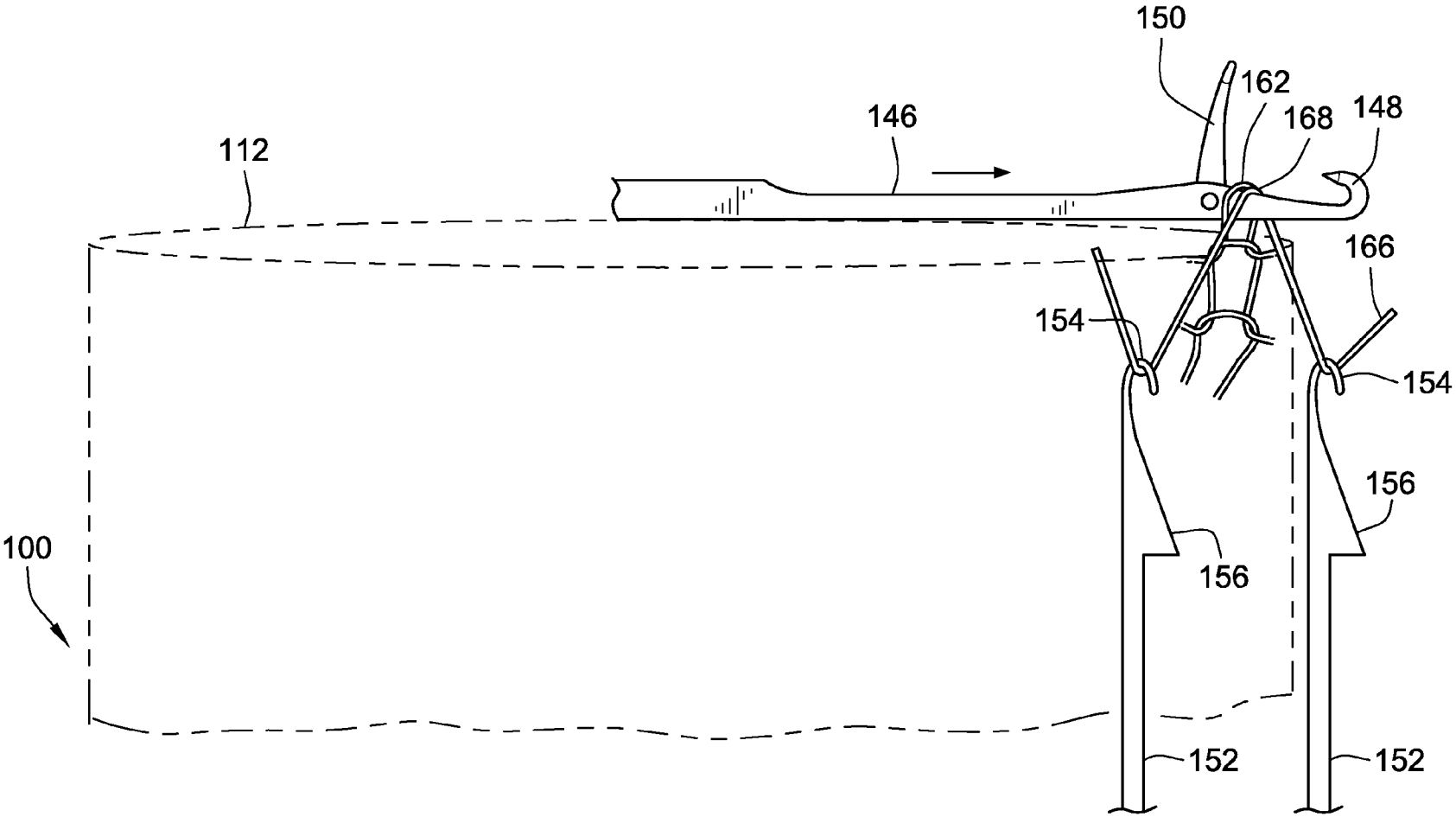
FIG. 13 is a schematic view of the dial needle and the cylinder needles and the tubular paint roller fabric shown in FIGS. 8 through 12, with the dial needle moving in a distal direction and the old backing loop and the new pile loop beginning to open the latch of the dial needle, and with the cylinder needles remaining in their fully downward position retaining the lower portions of the new pile loop.

Referring first to FIG. 13 in contrast with FIG. 12, it may be seen that the dial needle 146 has moved in a distal direction, and the backing loop 162 and the new pile loop 168 have begun to open the latch 150, causing the latch 150 to move to a position approximately midway between its closed and opened positions. Note that the backing loop 162 and the new pile loop 168 are adjacent the proximal end of the latch 150. The cylinder needles 152 remain in their fully proximal or resting position, as they will continue to do throughout the second stage of the knitting process.

Figure 14:
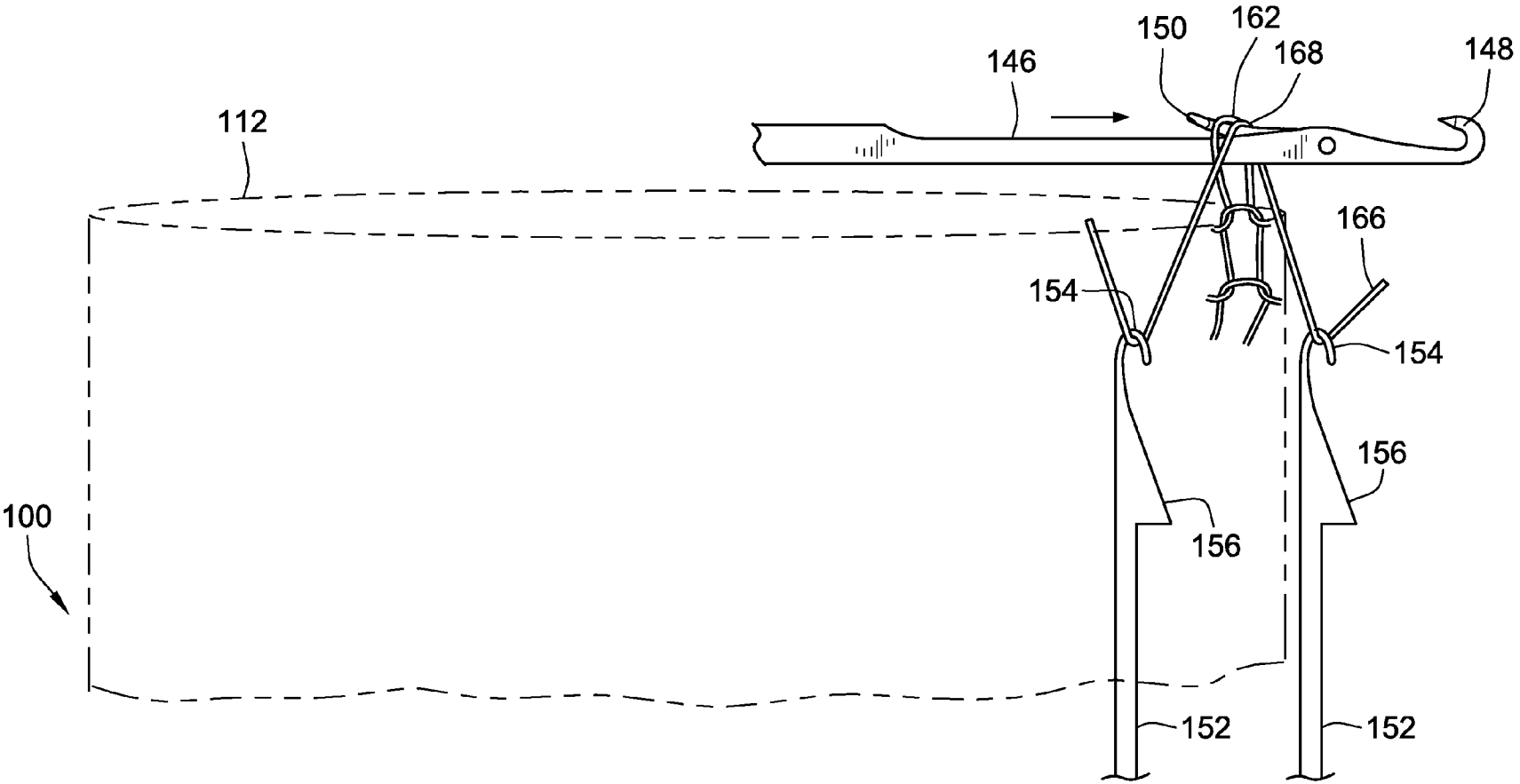
FIG. 14 is a schematic view of the dial needle and the cylinder needles and the tubular paint roller fabric shown in FIGS. 8 through 13, with the dial needle continuing to move in the distal direction and with the latch on the dial needle being in the tuck position with the old backing loop and the new pile loop being located on the latch of the needle, and with the cylinder needles remaining in their fully downward position retaining the lower portions of the new pile loop.

Referring now to FIG. 14 in contrast with FIG. 13, it may be seen that the dial needle 146 has continued to move in a distal direction, and the backing loop 162 and the new pile loop 168 are located nearly at the distal end of the latch 150, causing the latch 150 to move to its opened position. In this position, the backing loop 162 and the new pile loop 168 are about to fall off of the latch 150.

Figure 15:
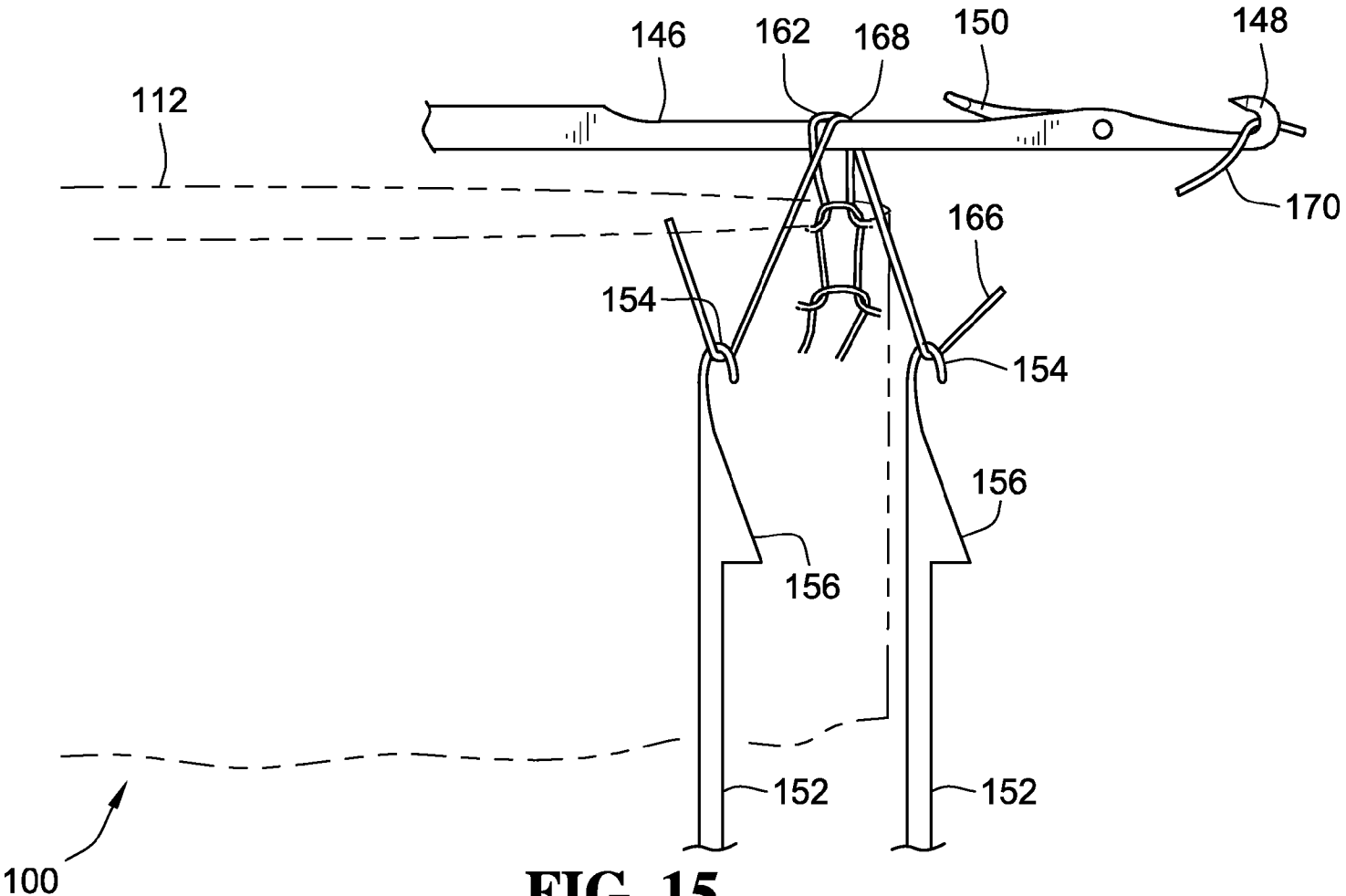
FIG. 15 is a schematic view of the dial needle and the cylinder needles and the tubular paint roller fabric shown in FIGS. 8 through 14, with the dial needle being in its fully distal position and the latch remaining in the tuck position with the old backing loop and the new pile loop having slipped over the end of the latch, and with the base yarn as it is engaged by the hook of the dial needle, with the cylinder needles remaining in their fully downward position retaining the lower portions of the new pile loop.

Referring next to FIG. 15 in contrast with FIG. 14, the dial needle 146 has moved to its fully distal or clearing position. With the dial needle 146 in its fully distal position, the backing loop 162 and the new pile loop 168 have slipped entirely off of the latch 150, and are located on the dial needle 146 in a position that is proximal to the latch 150. With the dial needle 146 in its clearing position, backing yarn 170 is inserted into the hook 148 of the dial needle 146.

Figure 16:
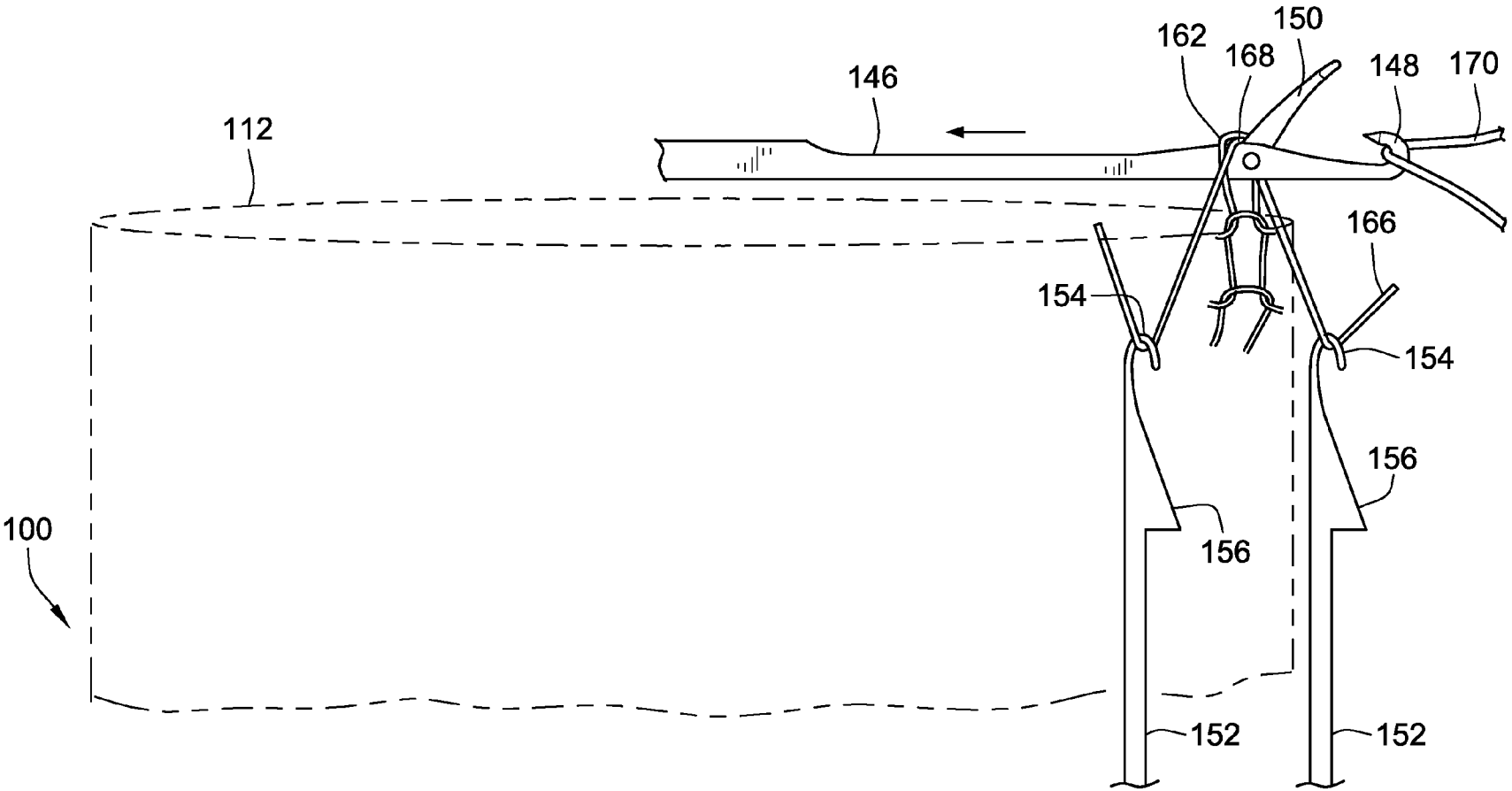
FIG. 16 is a schematic view of the dial needle and the cylinder needles and the tubular paint roller fabric shown in FIGS. 8 through 15, with the dial needle moving in a proximal direction and its hook capturing the base yarn to form a new backing loop in the vertical chain of backing loops, and with the latch being closed by the new cut-pile loop and the old backing loop as the dial needle moves in the proximal direction, with the cylinder needles remaining in their fully downward position retaining the lower portions of the new pile loop.

Referring now to FIG. 16 in contrast with FIG. 15, it may be seen that the dial needle 146 has begun to move in a proximal direction with the hook 148 of the dial needle 146 drawing the backing yarn 170 proximally (radially inwardly) with respect to the tubular segment 100, thereby beginning to create a new backing loop 172. As the dial needle 146 moves distally, the new pile loop 168 and the backing loop 162 have moved in a distal direction on the dial needle 146 and have engaged the latch 150, causing it to move from its opened position toward its closed position (it is shown in FIG. 16 as having moved slightly past its midway position).

Figure 17:
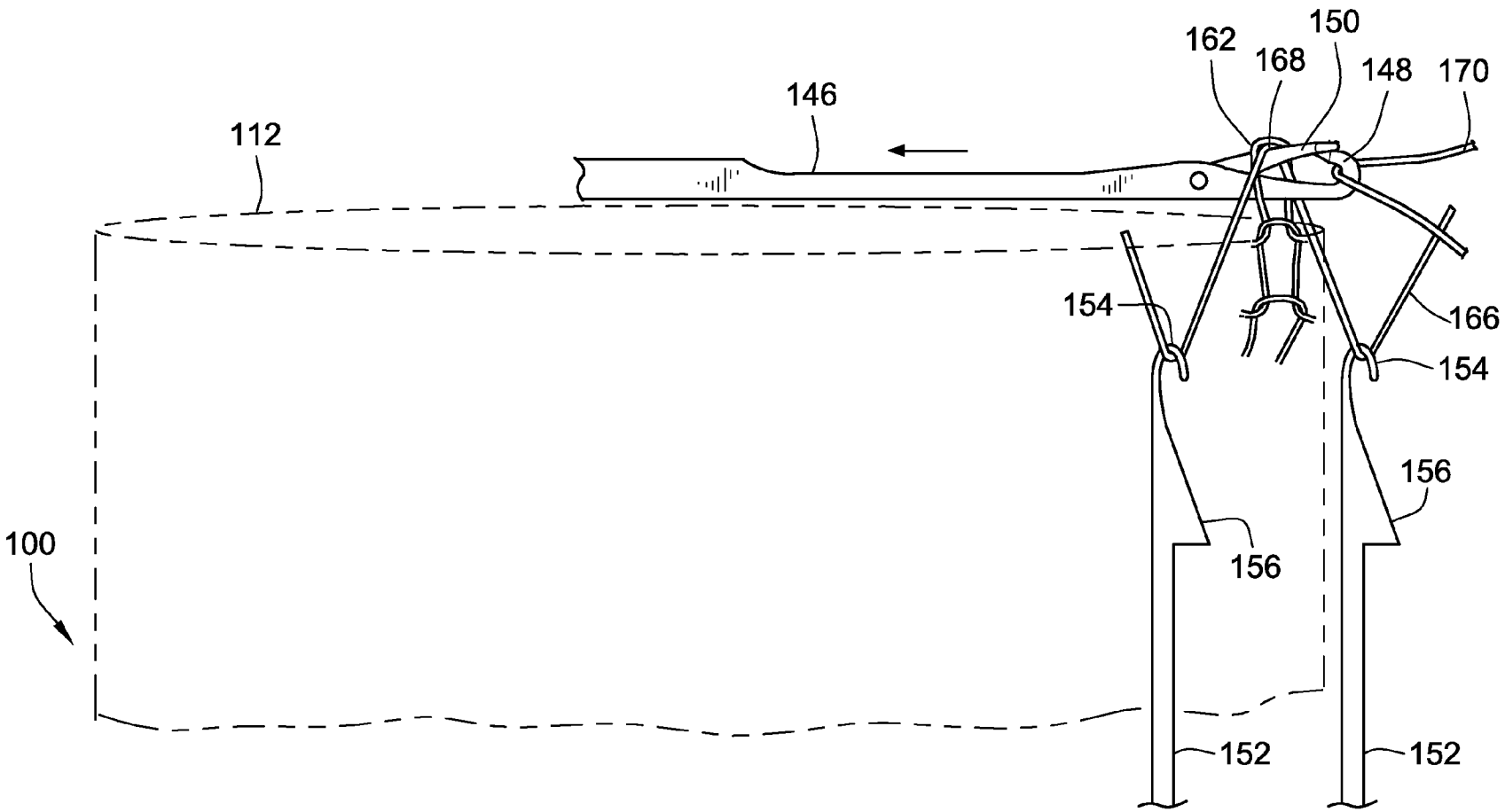
FIG. 17 is a schematic view of the dial needle and the cylinder needles and the tubular paint roller fabric shown in FIGS. 8 through 16, with the dial needle continuing to move in a proximal direction and its latch being completely closed by the new cut-pile loop and the old backing loop as the dial needle moves in the proximal direction, with the cylinder needles remaining in their fully downward position retaining the lower portions of the new pile loop.

Referring next to FIG. 17 in contrast with FIG. 16, it may be seen that the dial needle 146 the new backing loop 172 of the backing yarn 170 still being located on the hook 148 of the dial needle 146. As the dial needle 146 has continued to move distally, the new pile loop 168 and the backing loop 162 have moved in a distal direction on the dial needle 146 and have begun to slide over the latch 150, which is now in its closed position. The fact that the latch 150 is closed also assists in retaining the new backing loop 172 of the backing yarn 170 on the hook 148 of the dial needle 146.

Referring next to FIG. 18 in contrast with FIG. 17, it may be seen that the dial needle 146 has moved to its fully proximal or resting direction, and has pulled the new backing loop 172 of the backing yarn 170 through the new pile loop 168 and the backing loop 162. As this happened, the new pile loop 168 and the backing loop 162 slipped off of the latch 150 and over the hook 148 of the dial needle 146; this is referred as the new pile loop 168 and the backing loop 162 having been "cast off" the dial needle 146. Thus, the new backing loop 172 has been knitted through the new pile loop 168 and the backing loop 162, thereby locking the new pile loop 168 into the tubular segment 100. Thus, the tubular segment 100 is knitted with the new pile loop 168 extending outwardly. This completes the second stage $II_1$ of the knitting process, and is the starting point for the third stage $III_1$ of the knitting process, which is shown in FIGS. 19 and 20.

Referring first to FIG. 19 in contrast with FIG. 18, it may be seen that a cylinder 217 is schematically illustrated with an upwardly facing top edge 219. The top edge 219 of the cylinder 217 is located between the cylinder needles 152 and the tubular cut segment 100 (although it will be understood by those skilled in the art that the cylinder needles 152 are installed with their distal portions both mounted in and operated by the cylinder 217). Located above the top edge 219 of the cylinder 217 is a yarn cutting roll 250 having an outer edge 251 that contacts the top edge 219 of the cylinder 217 to pinch the portions of the pile yarn 166 that will comprise the ends 142, 149 of the new pile loop 168 therebetween. As this occurs, the cylinder needles 152 move in a distal (upward) direction such that their the tapered cutting edges 156 cut the new pile loop 168 free from the pile yarn 166. (Note that the cutting roll 250 itself does not do any cutting; rather, it only holds the pile yarn 166 in place while the cylinder needles 152 move to cause the tapered cutting edges 156 to cut the pile yarn 166.)

Figure 20:
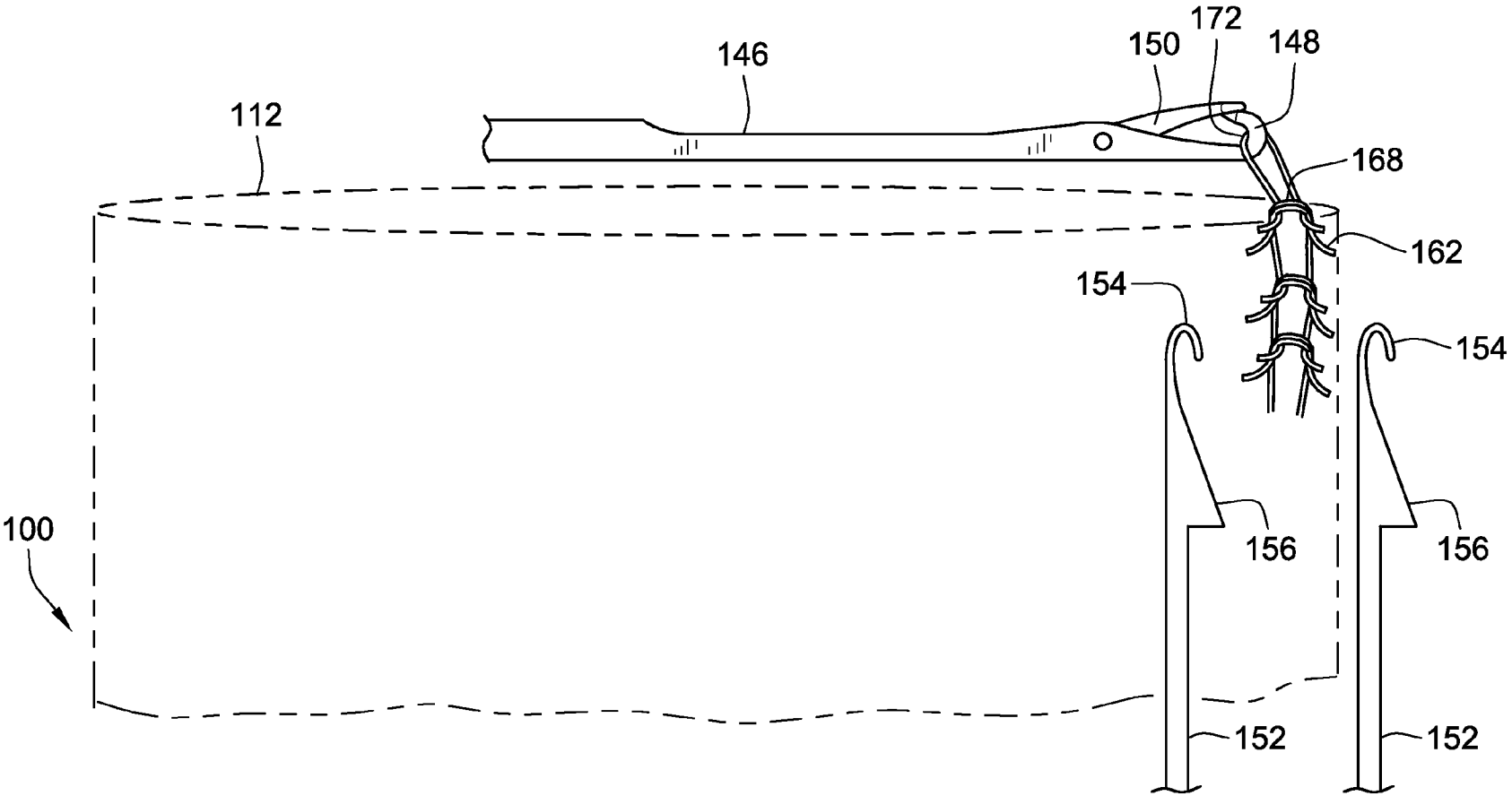
FIG. 20 is a schematic view of the dial needle and the cylinder needles and the tubular paint roller fabric shown in FIGS. 8 through 19, with the new pile loop having been cut from the pile yarn at both ends thereof, with the dial needle remaining in its resting position and the cylinder needles having returned to their fully downward position.

Referring finally to FIG. 20 in contrast with FIG. 19, it may be seen that the new pile loop 168 is locked in place in the tubular cut-pile knit segment 100 by the new backing loop 172, which has been knitted through the new pile loop 168 and the backing loop 162. By reviewing the operation described in FIGS. 8 through 20, which occurs repeatedly, it may thus be appreciated that the tubular cut-pile knit segment 100 is knitted with its cut-pile segments 110 extending outwardly.

Those skilled in the art will appreciate that while the process shown in FIGS. 8 through 20 has been depicted with only a single dial needle 146 and two cylinder needles 152, a plurality of alternating dial needles 146 and cylinder needles 152 will be used, all located, oriented, and moving in a manner similar to that described with reference to the dial needle 146 and the cylinder needles 152. In the preferred embodiment, between forty and one hundred of each of the dial needles 146 and the cylinder needles 152 will be used, with the currently preferred embodiment having approximately fifty of each of the dial needles 146 and the cylinder needles 152. It will be appreciated by those skilled in the art that the number of wales produced by a circular knitting machine is the same as the number of dial needles 146 used by the circular knitting machine.

As shown in FIG. 5, by way of example of formation of courses including tufts of sliver fibers 108, the construction of the portion of the tubular segment 100 in the area of the course 132 and the wale 126 will be discussed herein. The loop 134 formed in backing yarn segment 136 is located in this area, with a loop 131 formed in a yarn segment 139 being located in the course 116 below the loop 134, and the loop 130 formed in a yarn segment 132 being located in the course 120 above the loop 134. The loop 134 extends through the loop 131 from the outside to the inside of the tubular knit segment 100 (shown in FIG. 5), and the loop 130 also extends through the loop 134 from the outside to the inside. It will at once be appreciated by those skilled in the art that this arrangement of loops in sequentially knitted courses is completely opposite to the way in which sliver knit fabrics have been knitted on known circular knitting machines.

A tuft of pile fibers 108 having a loop portion 109 and opposite end portions 111 and 113 is knitted into the knit base material 104 together with the loop 134. The loop portion 109 of that particular tuft of pile fibers 108 is located adjacent the top of the loop 134, and the opposite end portions 112 and 113 of that particular tuft of pile fibers 108 extend outwardly from the interior of the loop 134, above the loop 131 and below the loop 130. In a similar manner, each of the other tufts of the pile fibers 108 is knitted into the knit base material 104 with a different loop.

Figure 21:
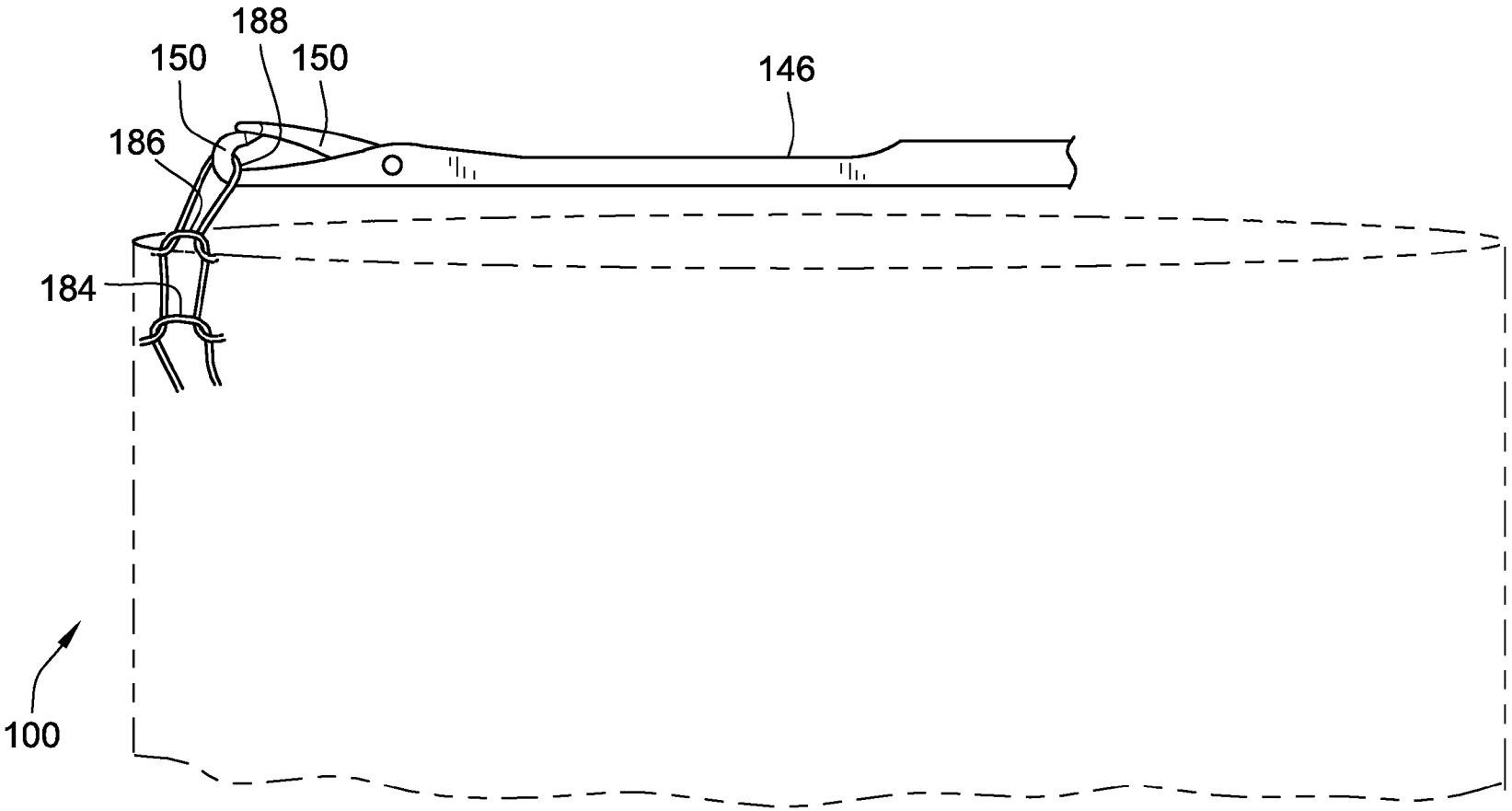
FIG. 21 is a schematic view of a knitting needle having a hook located at the distal end thereof and a latch pivotally mounted at a position proximal from the hook, the knitting needle being used to knit a tubular paint roller fabric similar to the one illustrated in FIGS. 1 and 2, with the needle being in a resting position with regard to an old loop.
Figure 22:
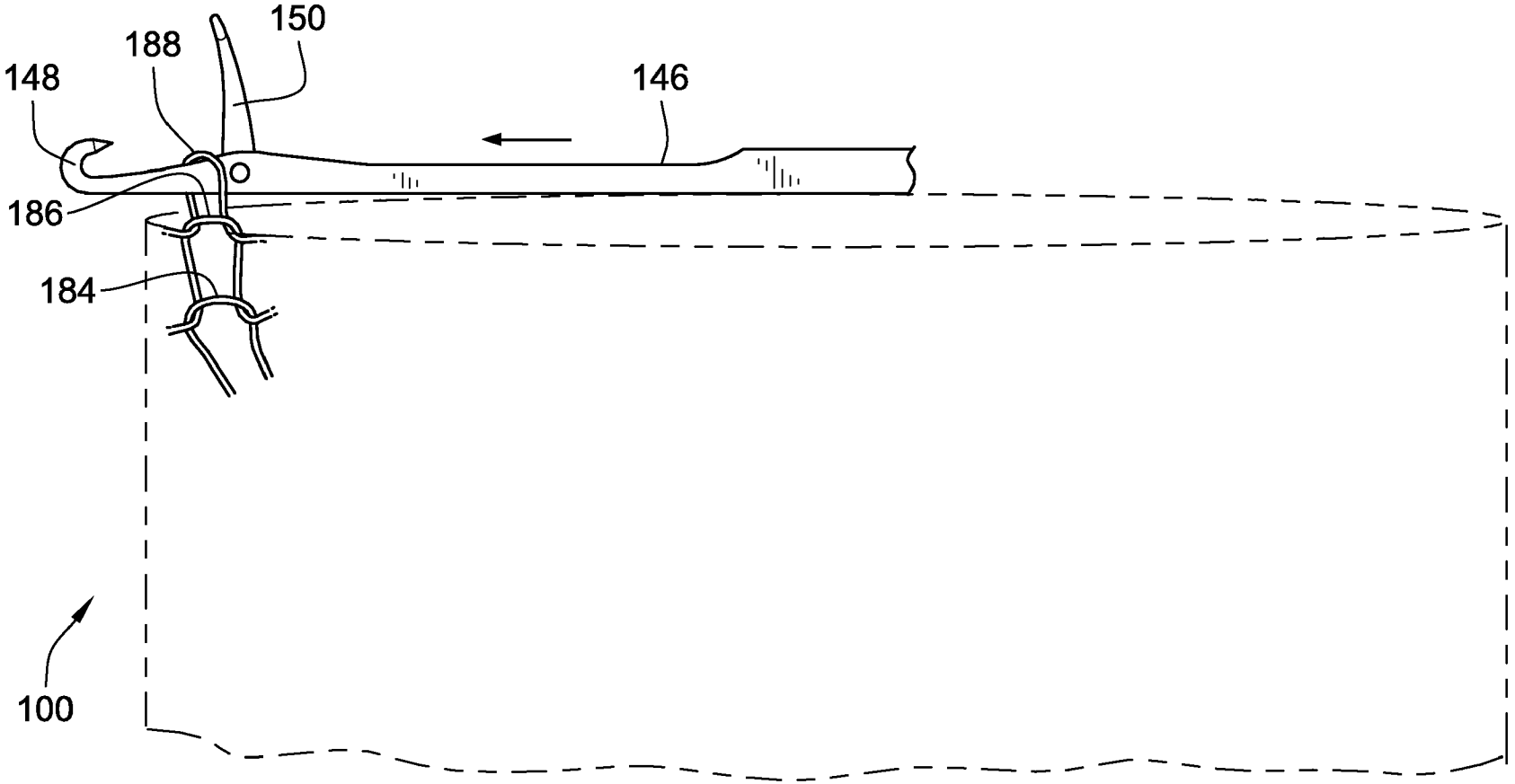
FIG. 22 is a schematic view of the knitting needle and the tubular paint roller fabric shown in FIG. 21, with the needle moving in a distal direction and the old loop opening the latch of the needle.
Figure 23:
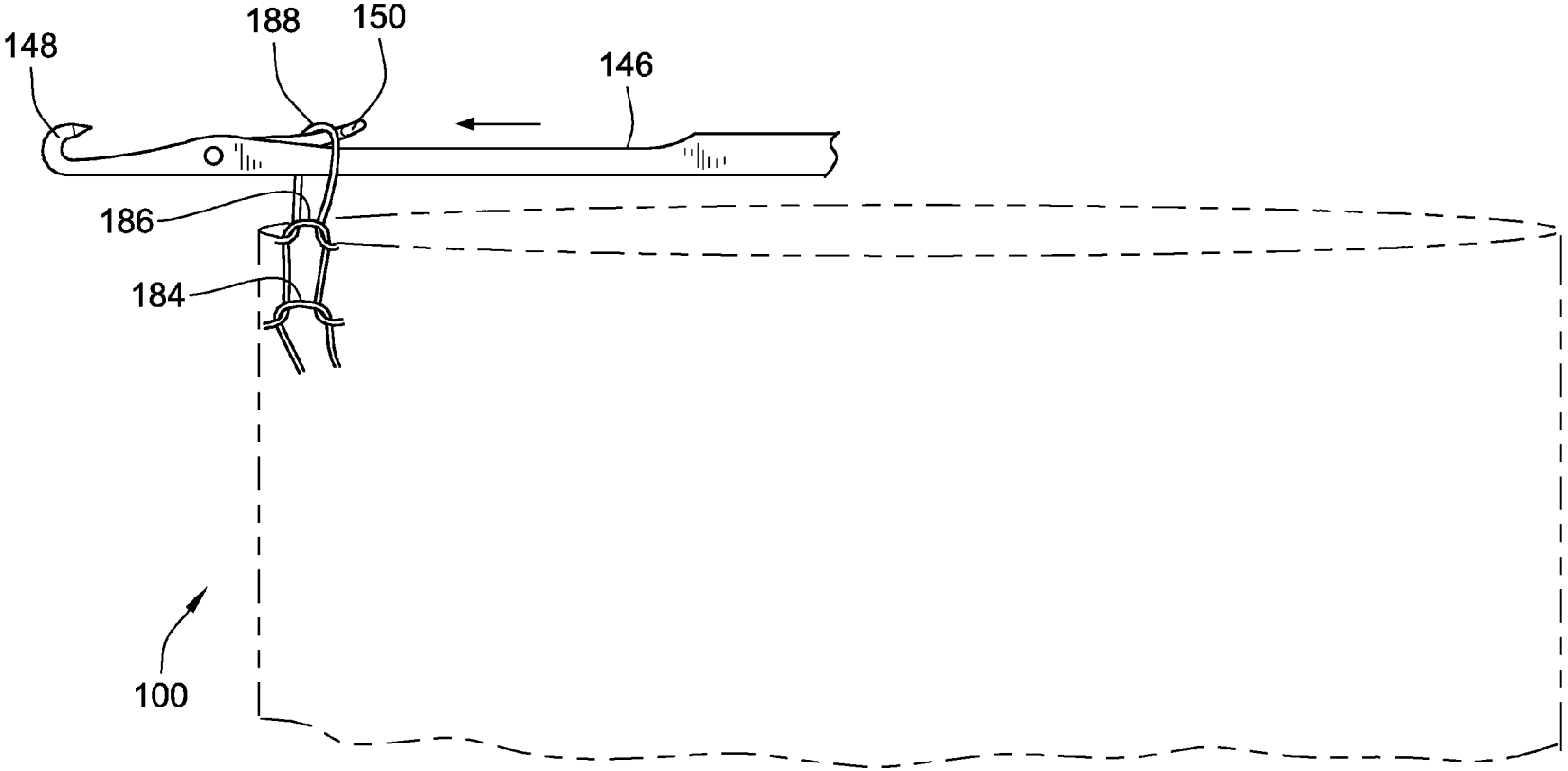
FIG. 23 is a schematic view of the knitting needle and the tubular paint roller fabric shown in FIGS. 21 and 22, with the needle continuing to move in a distal position and the latch being in a tuck position.
Figure 24:
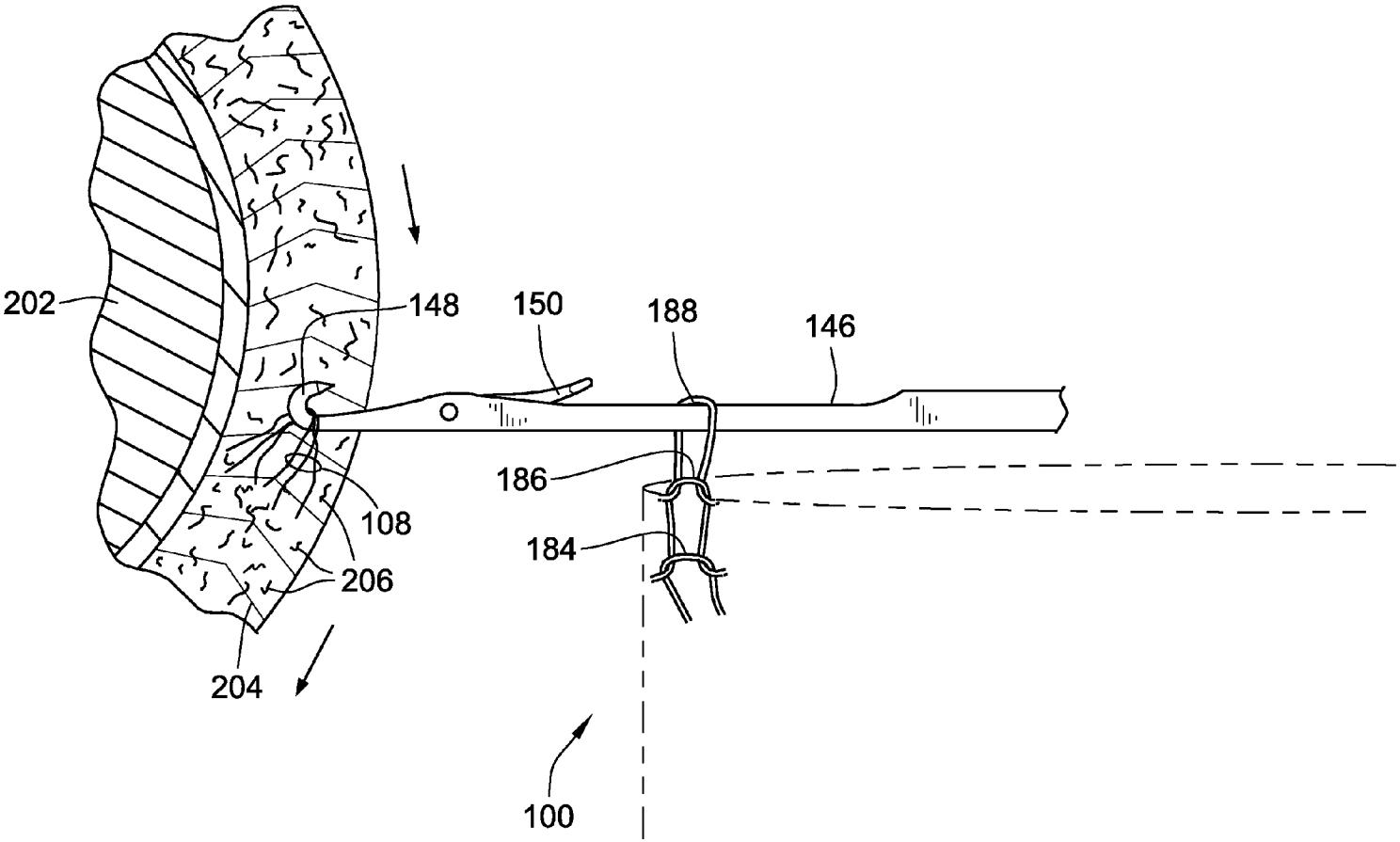
FIG. 24 is a schematic view of the knitting needle and the tubular paint roller fabric shown in FIGS. 21 through 23 and also showing a doffer roll having a wire face with sliver fibers thereon, with the needle being in a doff position (its fully distal position) and sliver fiber from the doffer roll being received on the hook of the needle.
Figure 25:
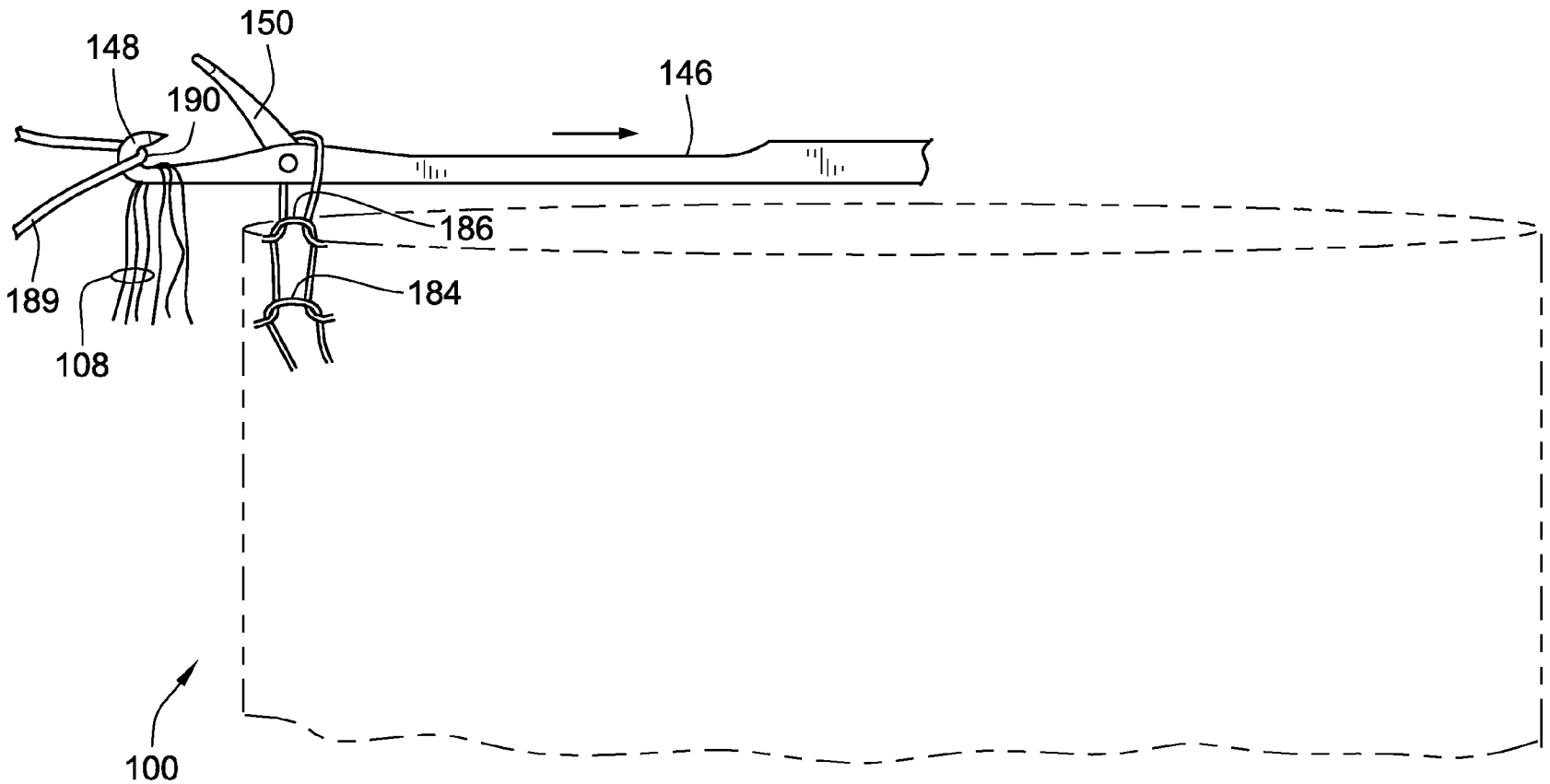
FIG. 25 is a schematic view of the knitting needle and the tubular paint roller fabric shown in FIGS. 21 through 24, with the needle moving in a proximal direction and the hook capturing the base yarn for a new loop in the vertical chain of loops, and with the latch being closed by the old loop as the needle moves in the proximal direction.

FIGS. 21 through 27 illustrate a sliver knitting process which may be used to knit the sliver fiber courses 114, 118 and 122 of tubular sliver knit segment 100 shown in FIGS. 1 and 5. These figures show in sequential fashion how a stitch is formed by these steps $I_2$, $II_2$, $III_2$ (see FIG. 7) in the sliver pile courses 114, 118 and 122. Each of these figures shows a dial 146 needle having a hook 148 located at the distal end thereof and a latch 150 that has a proximal end that is pivotally mounted at a location on the needle 146 that is proximal of the hook 148. The latch 150 can pivot between a closed position (shown in FIGS. 21, 26, and 27) in which the distal end of the latch 150 contacts the end of the hook 148 to form an enclosed area with the hook 148, and an opened position (shown in FIGS. 23 and 24) in which the distal end of the latch 150 forms a small acute angle with the proximal end of the needle 146. FIGS. 22 and 25 show the latch 150 in intermediate positions.

FIGS. 21 through 27 also show the tubular knit segment 100 in phantom lines, with only several loops in a single wale being shown in solid lines. Specifically, sequential loops 184, 186, and 188 are shown in each of FIGS. 21 through 27, with the loops 184, 186, and 188 being in courses that are knitted sequentially from the course containing the lowest loop number (184) to the course containing the highest loop number (188). The knitting process shown in FIGS. 21 through 27 shows the knitting of a new loop 190 in a new course being knit above the loop 188.

Note that in each of FIGS. 21 through 27, the needle 146 is generally located inside the tubular knit segment 100 with its distal end (the end with the hook 148) extending from the interior of the tubular knit segment 100 outwardly. Thus, movement of the needle 146 in a proximal direction is defined as movement radially inwardly with respect to the tubular knit segment 100, and movement of the needle 146 in a distal direction is defined as movement radially outwardly with respect to the tubular knit segment 100. Those skilled in the art will at once appreciate that the location, orientation, and movement of the needle 146 is radically different from the location, orientation, and movement of needles in currently known circular knitting machines. (The needles in currently known circular knitting machines are typically oriented essentially parallel to the axis of the tubular segment being knit, with the hooks of the needles located above the top end of the tubular segment being knit.)

Referring first to FIG. 21, the needle 146 is in its fully proximal or resting position, with the loop 188 engaged by the hook 148 of the needle 146 (near the distal-most end of the needle 146) and with the latch 150 in its closed position with the distal end of the latch 150 adjacent the distal end of the hook 148.

Referring next to FIG. 22 in contrast with FIG. 21, it may be seen that the needle 146 has moved in a distal direction, and the loop 188 has opened the latch 150 and caused the latch 150 to move to a position approximately midway between its closed and opened positions. Note that the loop 188 is adjacent the proximal end of the latch 150.

Referring now to FIG. 23 in contrast with FIG. 22, it may be seen that the needle 146 has continued to move in a distal direction, and the loop 188 is located nearly at the distal end of the latch 150 with the latch 150 remaining in the opened position. In this position, the loop 188 is about to fall off of the latch 159, although the loop 188 will remain on the needle 146.

Referring next to FIG. 24, the circular knitting machine 200 of which the needle 146 is a part includes a doffer roll 202 having a wire face 204. The doffer roll 202 is part of a doffer arrangement 201 of the exemplary embodiment of circular knitting machine 200 illustrated herein in FIGS. 6 and 7. Those skilled in the art will immediately appreciate that the location and orientation of the doffer roll 202 is also radically different from the location and orientation of doffer rolls in currently known circular knitting machines. (The doffer rolls in currently known circular knitting machines are located above the hooks of the needles, which needles, as mentioned above, are oriented parallel to the axis of the tubular segment being knit, with the hooks of the needles being located above the top end of the tubular segment being knit.)

The doffer roll 202 is rotating in a clockwise direction, and it carries sliver fibers 206 in the wire face 202, the sliver fibers 206 being supplied from a sliver rope (not shown) being fed into the head (not shown) that contains the doffer roll 202 and the wire face 204.

As indicated in FIG. 7, the courses having a pile made from sliver fibers are knitted in three steps $I_2$, $II_2$, $III_2$, using only the dial needles 146 in cooperation with the doffer arrangement 201 and the second backing yarn feeding arrangement 222. In general, the operations taking place in step $I_2$ are illustrated and described below in conjunction with FIGS. 23 and 24; the operations carried out in step $II_2$ are illustrated and described below in conjunction with FIGS. 25 and 26; and the operations carried out in step $III_2$ are illustrated and described below with regard to FIG. 27.

As shown in FIGS. 7 and 23, at the completion of the final step $III_1$ of the process used for knitting a course of cut-fiber pile, the dial needles 146 begin to move radially outward toward an extended position at which the hooks 148 of the dial needles will engage the wire face tool 4 of the doffer roll 202, so that the hooks 148 may receive a tuff of pile fibers 108 from the wire face tool 4 of the doffer roll 202.

As may be seen in FIG. 24 in contrast with FIG. 23, the needle 146 has moved to its fully distal position, which places the hook 148 of the needle 146 into the wire face 204 of the doffer roll 202. The rotation of the doffer roll 202 causes some of the sliver fibers 206 in the wire face 204 to become engaged by the hook 148, forming a tuft of pile fibers 108 on the hook 148. It may also be noted that with the needle 146 in its fully distal position, the loop 188 has slipped entirely off of the latch 150, and is located on the needle 146 in a position that is proximal to the latch 150. It is noted, however, that in the courses having a pile made from a yarn rather than sliver fibers, as described above, the needles 146 may only need to move outward to a "tuck" position, as shown in FIG. 23, to have the hook 148 receive the fiber which is cut to form the cut-fiber pile. Having the needles 146 move outward to only the tuck position provides more support for the needles 146, and may provide a more robust design.

Referring now to FIG. 25 in contrast with FIG. 24, it may be seen that the needle 146 has begun to move in a proximal direction with the tuft of the pile fibers 108 still being located on the hook 148 of the needle 146. The hook 148 is now located away from the wire face 204 of the doffer roll 202 (not shown in FIG. 25), and the hook 148 has also engaged a backing yarn segment 189 and begun to form a new loop 190 of the backing fabric 104. As the needle 146 has moved distally, the loop 188 has moved in a proximal direction on the needle 146 and has engaged the latch 150, causing it to move from its opened position toward its closed position (it is shown in FIG. 25 as having moved slightly past its midway position).

Figure 26:
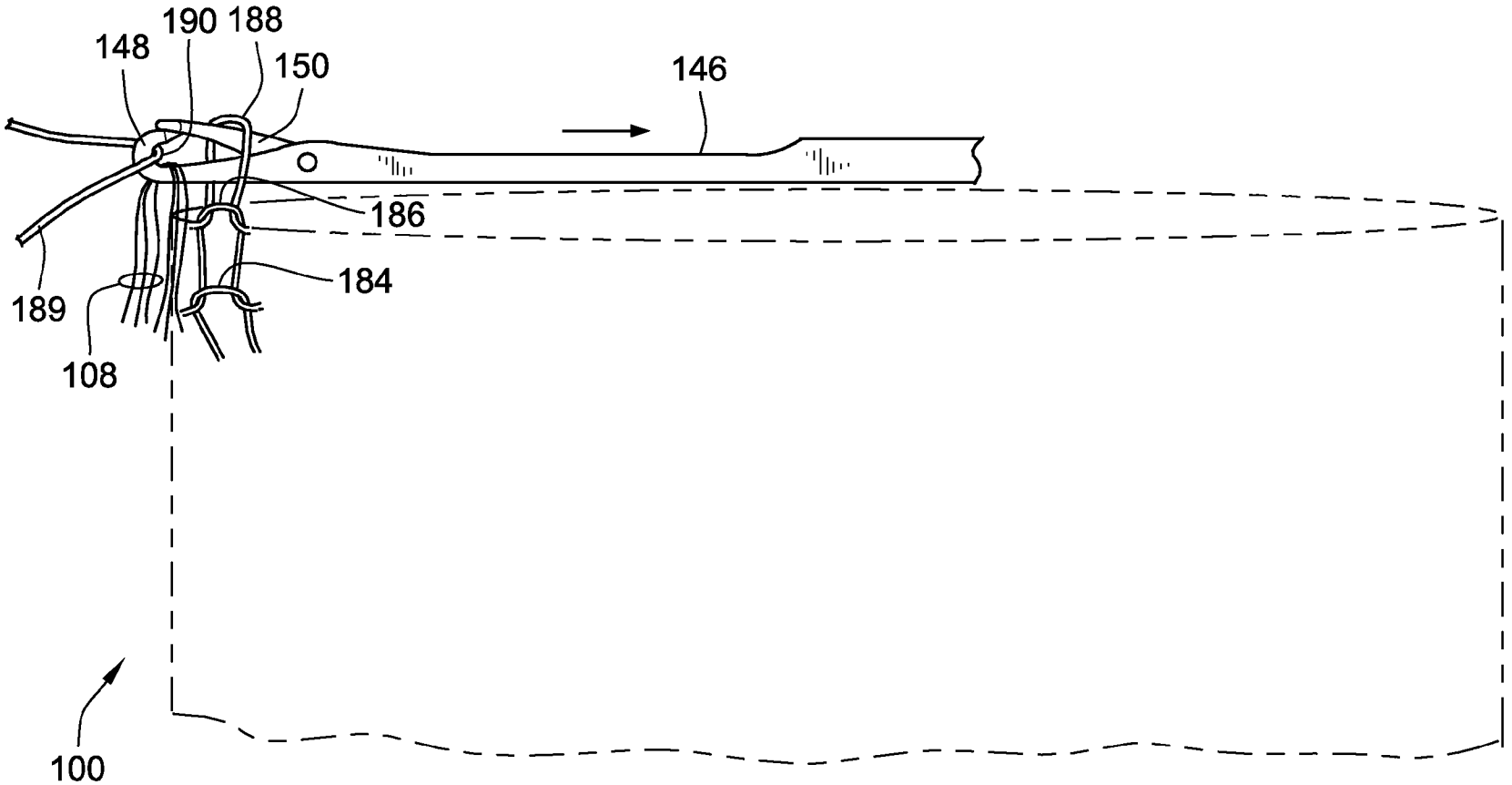
FIG. 26 is a schematic view of the knitting needle and the tubular paint roller fabric shown in FIGS. 21 through 25, with the needle continuing to move in a proximal direction and the latch being completely closed.

Referring next to FIG. 26 in contrast with FIG. 25, it may be seen that the needle 146 has continued to move in a proximal direction, with both the tuft of the pile fibers 108 and the loop 190 of the backing yarn segment 189 still being located on the hook 148 of the needle 146. As the needle 146 has continued to move distally, the loop 188 has moved in a proximal direction on the needle 146 and has begun to slide over the latch 150, which is now in its closed position. The fact that the latch 150 is closed also assists in retaining both the tuft of the pile fibers 108 and the loop 190 of the yarn segment 189 on the hook 148 of the needle 146.

Figure 27:
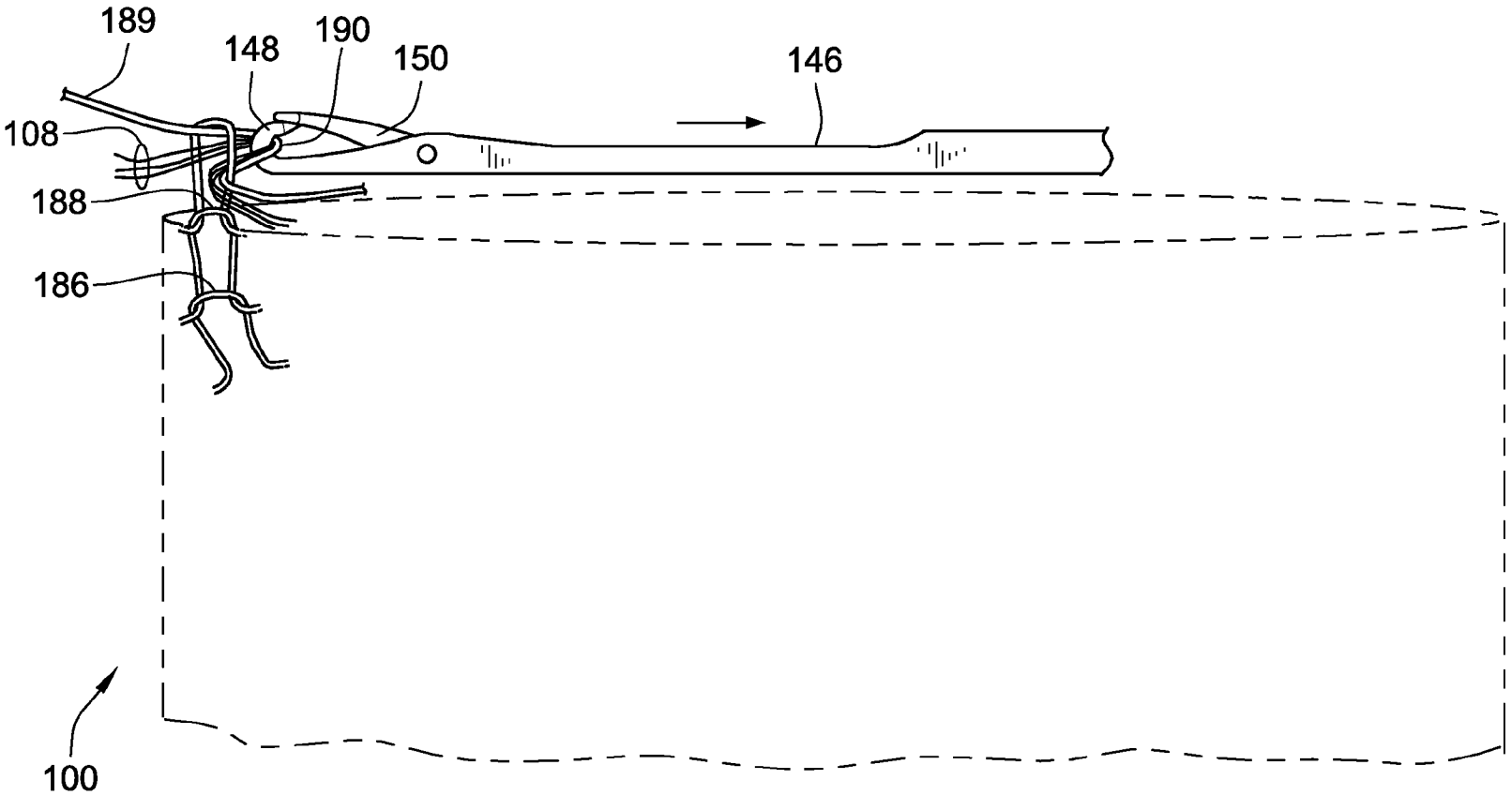
FIG. 27 is a schematic view of the knitting needle and the tubular paint roller fabric shown in FIGS. 21 through 26, with the needle in its fully proximal direction and with the old loop having been cast off and the new loop having been formed.

Referring next to FIG. 27 in contrast with FIG. 26, it may be seen that the needle 146 has moved nearly to its fully proximal or resting direction, and has pulled the new loop 190 of the backing yarn segment 189 and the loop of the new tuft of the pile fibers 108 through the loop 188. As this happened, the loop 188 slipped off of the hook 148 and the latch 150 of the needle 146. This is referred as the loop 188 having been "cast off" the needle 146. Thus, the new loop 190 has been knitted through the loop 188, with the new tuft of the pile fibers 108 having their midpoints adjacent the top of the loop 190, and their ends extending outwardly from the tubular knit segment 100. Thus, the tubular knit segment 100 is knitted with the sliver pile fibers 108 extending outwardly.

Those skilled in the art will appreciate that while the process shown in FIGS. 21 through 27 has been depicted with only a single dial needle 146, a plurality of needles may be used in practicing the invention, all located, oriented, and moving in a manner similar to that described with reference to the needle 146. In various embodiments, for example, it is contemplated that between forty and one hundred needles may be used, with the exemplary embodiment 100 described herein having approximately fifty needles. It will be appreciated by those skilled in the art that the number of wales produced by a circular knitting machine is the same as the number of needles used by the circular knitting machine.

A wide variety of materials may be used to knit the backing 104 of the tubular knit segment 100, and the pile of the tubular knit paint roller cover fabric of the present invention may be made of virtually any of the materials used in cut-pile knit fabrics in the past. For example, the backing and pile yarns or slivers may each be made of natural or synthetic yarn fibers, or a blend of natural and synthetic fibers in the yarn. Natural fibers used in the backing and pile face may be, for example, wool. Synthetic fibers used in the knit base may be, for example, polyester, acrylic, polypropylene, aramid, and spandex, or a blend of any of the aforementioned. Synthetic fiber yarns used in the pile face may be, for example, polyester, acrylic, nylon, modacrylic, rayon, polypropylene, and aramid, or a blend of any of the aforementioned. The backing yarn may optionally be made at least in part of a low melt material, such as the yarn used for the base in the above-incorporated by reference U.S. Pat. No. 6,766,668, to Sinykin. Yarn deniers for both the backing and pile face may be between approximately seventy-five and approximately one thousand five hundred, although yarns outside these ranges may be useable as well. The pile face may use yarns or slivers ranging from microdenier fibers to polyamide fibers.

Returning now to FIGS. 2 through 4, the installation of the tubular cut-pile knit segment 100 onto a paint roller cover core 106 is schematically illustrated. The installation method depicted in FIGS. 2 through 4 is fully disclosed in copending U.S. patent application Ser. No. 12/100,050, filed on Apr. 9, 2008, entitled "Method of Manufacturing Paint Roller Covers From a Tubular Fabric Sleeve," which patent application is assigned to the assignee of the present invention, and which patent application is hereby incorporated herein by reference in its entirety. Alternately, other installation methods can be used as well, including those disclosed in copending U.S. patent application Ser. No. 12/015,612, filed on Jan. 17, 2008, entitled "Method of Manufacturing Paint Roller Covers From a Tubular Fabric Sleeve," which patent application is assigned to the assignee of the present invention, and which patent application is hereby incorporated herein by reference in its entirety.

It will be appreciated by those skilled in the art that the paint roller cover core 106 may constitute plastic tubular core stock that has been cut to single paint roller size (typically nine inches (229 millimeters)). (Alternately, it may be cut to a longer length, such as, for example, sixty-four inches (1625 millimeters); if such a longer length is used, following installation of the tubular cut-pile knit segment 30 onto the plastic tubular core stock, it may be cut into the desired size shorter paint roller covers, such as, for example, seven nine inch (229 millimeters) paint roller covers.) Finishing the paint roller covers typically will include the steps of combing the knit fabric having alternating courses of sliver fiber pile and cut-pile on the paint roller cover and shearing the knit fabric having alternating courses of sliver fiber pile and cut-pile to the desired length. These finishing steps may occur either before or after cutting longer segments to the desired length. Finally, the edges of the paint roller covers are beveled, and any loose yarn fibers may be vacuumed off.

Referring now to FIG. 2, the paint roller cover core 106 covered with a non-tacky adhesive 105 is illustrated. The tubular knit segment 100 is shown as it is about to be pulled onto the exterior surface of the paint roller cover core 106. The tubular cut-pile knit segment 100 has an inner diameter that is approximately the same size as or slightly smaller than the outer diameter of the paint roller cover core 106, which outer diameter is typically approximately one and five-eighths inches (41 millimeters) to one and three-quarters inches (44 millimeters) (the inner diameter of the core member 106 is approximately one and one-half inches (38 millimeters), although alternative sizes such as inner diameters of one and three-quarters inches (44 millimeters) and two inches (51 millimeters) could be used as well). The tubular knit segment 100 may be sized to require that it be stretched slightly when it is placed onto the paint roller cover core 106 in order to achieve the correct density and/or positioning. Alternately, the tubular knit segment 100 could also be slightly larger than the outer diameter of the paint roller cover core 106 onto which it is to be installed and shrunk slightly to closely fit the paint roller cover core 106.

The tubular knit segment 100 is of a length that corresponds to the length of the paint roller cover core 106. For purposes of the example discussed herein, it will be assumed that the paint roller cover core 106 is approximately nine inches (229 millimeters) long and that the tubular knit segment 100 is approximately nine to nine and one-quarter inches (235 millimeters) long, which are lengths that are selected to allow the paint roller cover core 106 and the tubular knit segment 100 to be used for the manufacture of a single nine inch (229 millimeter) long paint roller cover. It will be appreciated by those skilled in the art that the paint roller cover core 106 and the tubular knit segment 100 could alternately be sized for use in manufacturing a plurality of paint roller covers of any of several different lengths. For example, the paint roller cover core 106 and the tubular knit segment 100 could each be approximately sixty-four inches (1625 millimeters) long, which is a sufficient length to allow them to be used for the manufacture of seven nine inch (229 millimeter) long paint roller covers 107.

Since inner diameter of the tubular knit segment 100 is approximately the same as the paint roller cover core 106, the tubular knit segment 100 need not be capable of substantial stretching when it is pulled onto the paint roller cover core 106. The tubular knit segment 100 having outwardly extending pile made from alternating courses of sliver fibers tufts and cut-fibers, as taught herein, is resilient and will closely fit the outer diameter of the paint roller cover core 106.

In FIG. 2, the tubular knit segment 100 is shown about to be pulled over the paint roller cover core 106. FIG. 3 shows the tubular knit segment 100 partly pulled onto the paint roller cover core 106, and FIG. 4 shows the tubular knit segment 100 fully pulled onto the paint roller cover core 106. The tubular knit segment 100 is subsequently adhesively secured to the paint roller cover core 106 by the application of heat to cause the non-tacky adhesive 105 melt, thereby adhering the tubular cut-pile knit segment 100 the paint roller cover core 106, as fully described in U.S. patent application Ser. No. 12/100,050, filed on Apr. 9, 2008.

Finishing the paint roller covers 107 will include the steps of combing the pile on the paint roller cover 107 and shearing the knit fabric having alternating courses of sliver fiber pile and cut-pile to the desired length. Finally, the edges of the paint roller covers 107 are beveled, and any loose yarn fibers may be vacuumed off.

It may therefore be appreciated from the above detailed description of the preferred embodiment of the present invention that it provides a tubular knit paint roller cover fabric having outwardly extending pile made of alternating courses of sliver fibers and cut-pile fibers that is suitable for use in the manufacture of a paint roller cover. The tubular knit paint roller cover fabric of the present invention is manufactured with the pile side facing outwardly rather than inwardly, thereby obviating the need to invert it prior to mounting it on a paint roller cover core. The tubular knit paint roller cover fabric of the present invention is of a size suitable for mounting on a paint roller cover core in a seamless manner, without cutting it except for cutting it to a length fitting the length of paint roller cover core material on which the tubular knit paint roller cover fabric is to be mounted.

The tubular knit paint roller cover fabric of the present invention, having outwardly extending pile made of alternating courses of sliver fibers and cut-pile fibers, is well suitable for use in its application on a paint roller cover, and will not experience any significant degradation of the tubular knit paint roller cover fabric due to its contact with a wide variety of paints, enamels, stains, etc. The tubular knit paint roller cover fabric of the present invention is manufactured in a manner in which the pile loops are securely retained by the knit base material such that the shedding of pile fibers from the tubular knit paint roller cover fabric is minimized. The tubular knit paint roller cover fabric of the present invention is also manufacturable in extended length segments that may later be cut to tubular segments of any desired length.

The tubular knit paint roller cover fabric of the present invention, having outwardly extending pile made of alternating courses of sliver fibers and cut-pile fibers, is of a construction which is both durable and long lasting when it has been secured to a paint roller cover core, and the resulting paint roller cover will provide the user with an acceptably long lifetime. The tubular knit paint roller cover fabric of the present invention is also inexpensive to manufacture, thereby enhancing its market appeal and to affording it the broadest possible market. Finally, all of the aforesaid advantages and objectives of the tubular knit paint roller cover fabric of the present invention are achieved without incurring any substantial relative disadvantage.

Although the foregoing description of the tubular knit paint roller cover of the present invention, having outwardly extending pile made of alternating courses of sliver fibers and cut-pile fibers, has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A knit pile fabric suitable for use on paint roller covers, said knit pile fabric comprising:

a knitted base fabric having a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric;

a plurality of cut-pile segments, each of said cut-pile segments having opposite ends with a loop portion located therebetween, said loop portion of each of said plurality of cut-pile segments being knitted together with a loop of said base fabric into said base fabric, said opposite ends of said plurality of cut-pile segments extending outwardly from said base fabric and forming the pile of said knit fabric; and a plurality of tufts of fibers, each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming part of the pile of said knit pile fabric;

said plurality of cut-pile segments and said plurality of tufts of sliver knit fabric being disposed in alternating successive courses in the knit pile fabric.

2. A knit pile fabric as defined in claim 1, wherein said base fabric and said pile are knitted from yarns made of natural or synthetic yarn fibers, or a blend of natural and synthetic fibers.

3. A knit pile fabric as defined in claim 2, wherein said yarns have a denier of between seventy-five and one thousand five hundred.

4. A knit pile fabric as defined in claim 2, wherein the yarn used for said base fabric is made of wool, polyester, acrylic, polypropylene, aramid, spandex, or a blend of any of the aforementioned.

5. A knit pile fabric as defined in claim 2, wherein the yarn used for said cut-pile segments is made of wool, polyester, acrylic, nylon, modacrylic, rayon, polypropylene, aramid, or a blend of any of the aforementioned.

6. A knit pile fabric as defined in claim 1, wherein said cut-pile segments have a pile height of between approximately one-quarter inch and approximately three inches.

7. A knit pile fabric as defined in claim 1, wherein the number of wales in said tubular configuration base fabric is between approximately forty and approximately one hundred.

8. A knit pile fabric as defined in claim 7, wherein the number of wales in said tubular configuration base fabric is approximately fifty-six.

9. A knit pile fabric as defined in claim 1, wherein said tubular configuration base fabric has an inner diameter of approximately five inches or less.

10. A knit pile fabric as defined in claim 9, wherein said tubular configuration base fabric has an inner diameter that is approximately the same size as the outer diameter of a paint roller cover core.

11. A knit pile fabric as defined in claim 10, wherein said tubular configuration base fabric has an inner diameter of approximately one and one-half inches.

12. A knit pile fabric as defined in claim 1, wherein said tubular configuration base fabric is manufactured in an extended length that is substantially longer than the length of a paint roller.

13. A paint roller cover made in part from a knit pile fabric as defined in claim 1, said paint roller cover comprising:

a hollow cylindrical paint roller cover core; and a segment of said tubular configuration base fabric secured to the outside surface of said paint roller cover core.

14. A paint roller cover as defined in claim 13, wherein said tubular configuration base fabric is secured to the outside surface of said paint roller cover core using an adhesive.

15. A paint roller cover as defined in claim 13, wherein said tubular configuration base fabric is combed and sheared to the desired length after said segment of said tubular configuration base fabric is secured to the outside surface of said paint roller cover core.

16. A paint roller cover as defined in claim 15, wherein said tubular configuration base fabric is also beveled and vacuumed after said segment of said tubular configuration base fabric is secured to the outside surface of said paint roller cover core.

17. A knit pile fabric suitable for use on paint roller covers, said knit pile fabric comprising:

a knitted base fabric having a tubular configuration defining an outside and an inside, said base fabric having wales located adjacent each other and arranged around the circumference of said base fabric, said base fabric also having successive courses each of which is knit after a preceding course, said base fabric comprising a plurality of loops, wherein each loop in any particular wale is knitted through a loop in the preceding course in said particular wale;

a plurality of cut-pile segments, each of said cut-pile segments being knitted together with a loop of said base fabric into said base fabric with the ends of said cut-pile segments extending outwardly from said base fabric and forming part of the pile of said knit fabric; and a plurality of tufts of fibers, each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming part of the pile of said sliver knit fabric;

said plurality of cut-pile segments and said plurality of tufts of sliver knit fabric being disposed in alternating successive courses in the knit pile fabric.

18. A knit pile fabric suitable for use on paint roller covers, said knit pile fabric comprising:

a knitted base fabric having a tubular configuration defining an outside and an inside, said base fabric having between forty and one hundred wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric;

wherein said tubular configuration base fabric has an inner diameter that is approximately the same size as the outer diameter of a paint roller cover core; and a plurality of pile segments including cut-pile segments and tufts of sliver fiber pile segments;

each of said cut-pile segments having opposite ends with a loop portion located therebetween, said loop portion of each of said plurality of cut-pile segments being knitted together with a loop of said base fabric into said base fabric, said opposite ends of said plurality of cut-pile segments extending outwardly from said base fabric and forming part of the pile of said knit fabric, wherein said cut-pile segments have a pile height of between approximately one-quarter inch and approximately three inches;

each of said tufts of fibers having opposite ends with a loop portion located therebetween, said loop portion of each of said plurality of tufts being knitted together with a loop of said base fabric into said base fabric, said opposite ends of said plurality of tufts of fibers extending outwardly from said base fabric and forming a pile of said sliver knit fabric;

said plurality of cut-pile segments and said plurality of tufts of sliver knit fabric being disposed in alternating successive courses in the knit pile fabric.

19. A method of making a knit pile fabric comprising:

knitting a base fabric in a tubular configuration defining an outside and an inside, said base fabric having a predetermined number of wales located adjacent each other and arranged around the circumference of said base fabric, said base fabric having successive courses each of which is knit after a preceding course, said base fabric comprising a plurality of loops, wherein each loop in any particular wale is knitted through a loop in the preceding course in said particular wale from the outside to the inside of said tubular configuration of said base fabric;

providing a plurality of cut-pile segments, each of said cut-pile segments having opposite ends with a loop portion located therebetween;

providing a plurality of tufts of sliver pile segments; and knitting said loop portion of each of said cut-pile and tuft of sliver fiber segments together with a loop of said base fabric into said base fabric, said opposite ends of said plurality of cut-pile segments and said tufts of sliver pile segments extending outwardly from said base fabric and forming the pile of said knit fabric.

20. A method as defined in claim 19, wherein said base fabric and said pile are knitted from yarns made of natural or synthetic yarn fibers, or a blend of natural and synthetic fibers.

21. A method as defined in claim 20, wherein said yarns have a denier of between seventy-five and one thousand five hundred.

22. A method as defined in claim 20, wherein the yarn used for said base fabric is made of wool, polyester, acrylic, polypropylene, aramid, spandex, or a blend of any of the aforementioned.

23. A method as defined in claim 20, wherein the yarn used for said cut-pile segments is made of wool, polyester, acrylic, nylon, modacrylic, rayon, polypropylene, aramid, or a blend of any of the aforementioned.

24. A method as defined in claim 19, wherein said cut-pile segments have a pile height of between approximately one-quarter inch and approximately three inches.

25. A method as defined in claim 19, wherein the number of wales in said tubular configuration base fabric is between approximately forty and approximately one hundred.

26. A method as defined in claim 25, wherein the number of wales in said tubular configuration base fabric is approximately fifty-six.

27. A method as defined in claim 19, wherein said tubular configuration base fabric has an inner diameter of approximately five inches or less.

28. A method as defined in claim 27, wherein said tubular configuration base fabric has an inner diameter that is approximately the same size as the outer diameter of a paint roller cover core.

29. A method as defined in claim 28, wherein said tubular configuration base fabric has an inner diameter of approximately one and one-half inches.

30. A method as defined in claim 29, wherein said tubular configuration base fabric is manufactured in an extended length that is substantially longer than the length of a paint roller.

* * * * *